US012721406B2

(12) United States Patent
Sagara et al.

(10) Patent No.: US 12,721,406 B2
(45) Date of Patent: Sep. 1, 2026

(54) WOVEN FABRIC SURFACE FASTENER HAVING HOOK-SHAPED ENGAGING ELEMENT, AND METHOD FOR MANUFACTURING SAME

(71) Applicant: Kuraray Fastening Co., Ltd., Osaka (JP)

(72) Inventors: Makoto Sagara, Sakai (JP); Yoshikatsu Fujisawa, Sakai (JP)

(73) Assignee: Kuraray Fastening Co., Ltd., Osaka (JP)

( * ) Notice: Subject to any disclaimer, the term of this patent is extended or adjusted under 35 U.S.C. 154(b) by 261 days.

(21) Appl. No.: 18/704,261

(22) PCT Filed: Oct. 11, 2022

(86) PCT No.: PCT/JP2022/037759

§ 371 (c)(1),
(2) Date: Apr. 24, 2024

(87) PCT Pub. No.: WO2023/074339

PCT Pub. Date: May 4, 2023

(65) Prior Publication Data

US 2024/0415242 A1 Dec. 19, 2024

(30) Foreign Application Priority Data

Oct. 25, 2021 (JP) ..... 2021-173610

(51) Int. Cl.
*A44B 18/00* (2006.01)

(52) U.S. Cl.
CPC ..... *A44B 18/0038* (2013.01)

(58) Field of Classification Search
CPC . A44B 18/00; A44B 18/0023; A44B 18/0026; A44B 18/003; A44B 18/0038; A44B 18/0069; A44B 18/0088
See application file for complete search history.

(56) References Cited

U.S. PATENT DOCUMENTS 4,854,136 A 8/1989 Coslovi et al.
5,369,852 A 12/1994 Higashinaka
(Continued)

FOREIGN PATENT DOCUMENTS

EP 3 881 709 A1 9/2021
JP 35-522 1/1960
(Continued)

OTHER PUBLICATIONS

Machine Translation WO 2020-153160 (Year: 2020).*
(Continued)

*Primary Examiner* — Zachary M Davis
(74) *Attorney, Agent, or Firm* — Grüneberg Global IP, PLLC

(57) ABSTRACT

A woven-fabric hook-and-loop fastener including: a woven base fabric made of a woven-fabric made of a warp yarn and a weft yarn; a yarn for hook-shaped engaging elements made of a polyethylene terephthalate-based monofilament yarn woven into the woven base fabric in parallel with the warp yarn; and a plurality of the hook-shaped engaging elements formed from the yarn for the hook-shaped engaging elements and rising from a front face of the woven base fabric, on a front face side of the woven base fabric, in which a height of the hook-shaped engaging elements satisfies condition (1) described below and a hook shape of the hook-shaped engaging elements satisfies condition (2) described below: (1) 90% or more of the hook-shaped engaging elements present on the face of the base fabric have a height in a range of 0.975 to 1.025 times an average height (Ha) of the hook-shaped engaging elements; and (2) 90% or more of the hook-shaped engaging elements present on the face of the base fabric have a lateral-direction spread (W) of the hook-shaped engaging elements within a range of 0.7 to 0.8
(Continued)

times with respect to the height (H) of the hook-shaped engaging elements.

15 Claims, 3 Drawing Sheets

(56) References Cited

U.S. PATENT DOCUMENTS

| | | | |
|---|---|---|---|
| 2008/0289157 | A1 | 11/2008 | Higashinaka et al. |
| 2021/0219669 | A1 | 7/2021 | Kawabata et al. |
| 2022/0061470 | A1 | 3/2022 | Tanikawa |

FOREIGN PATENT DOCUMENTS

| | | | | |
|---|---|---|---|---|
| JP | 47-46145 | | 12/1972 | |
| JP | 63-200705 | | 8/1988 | |
| JP | 5-154009 | | 6/1993 | |
| JP | 2015-62600 | A | 4/2015 | |
| WO | 2005/122817 | | 12/2005 | |
| WO | WO-2019220809 | A1 * | 11/2019 | ..... D04B 21/02 |
| WO | 2020/149361 | | 7/2020 | |
| WO | WO-2020153160 | A1 * | 7/2020 | ..... D03D 15/00 |

OTHER PUBLICATIONS

International Search Report dated Dec. 20, 2022, in PCT/JP2022/037759, with English translation, 6 pages.
Written Opinion dated Dec. 20, 2022, in PCT/JP2022/037759, with English translation, 10 pages.
Official communication issued in European Patent Application No. 22886669.5 on Sep. 22, 2025, 10 pages.

* cited by examiner

[Fig. 1]
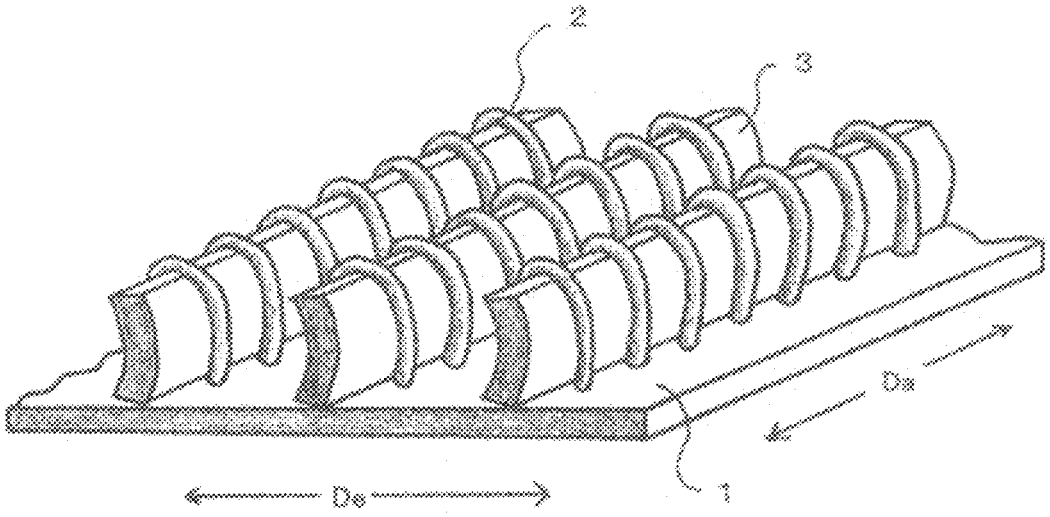
[Fig. 2]
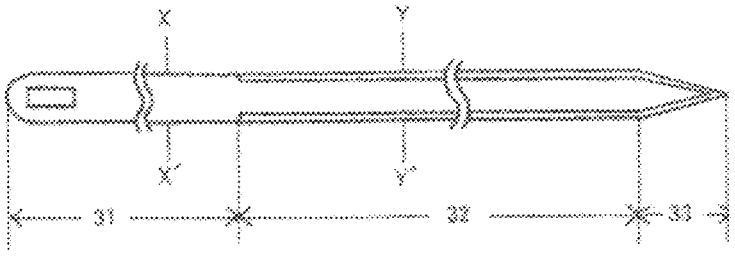
[Fig. 3]
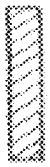
[Fig. 4]
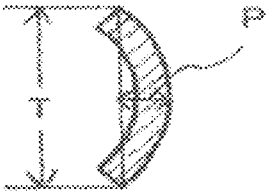

[Fig. 5]
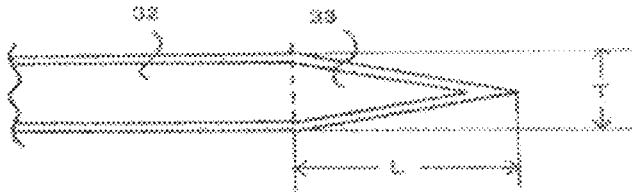
[Fig. 6]
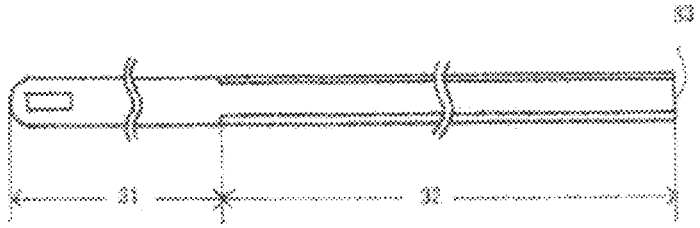
[Fig. 7]
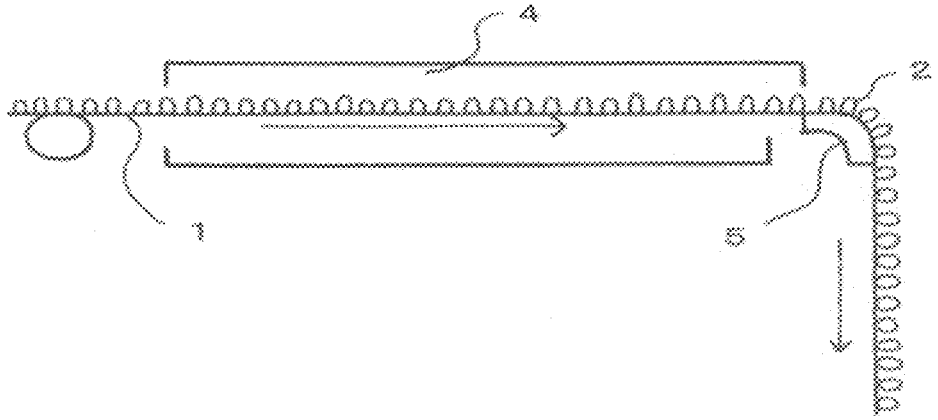
[Fig. 8]
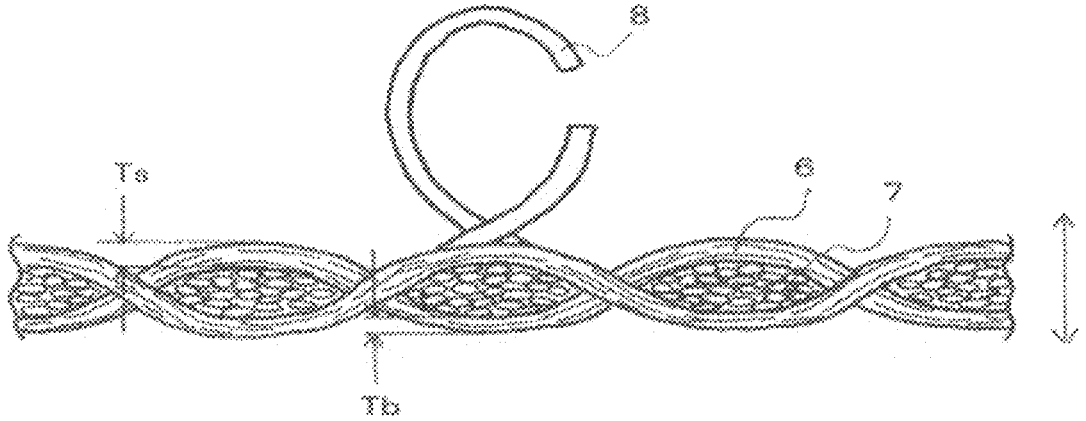

[Fig. 9]
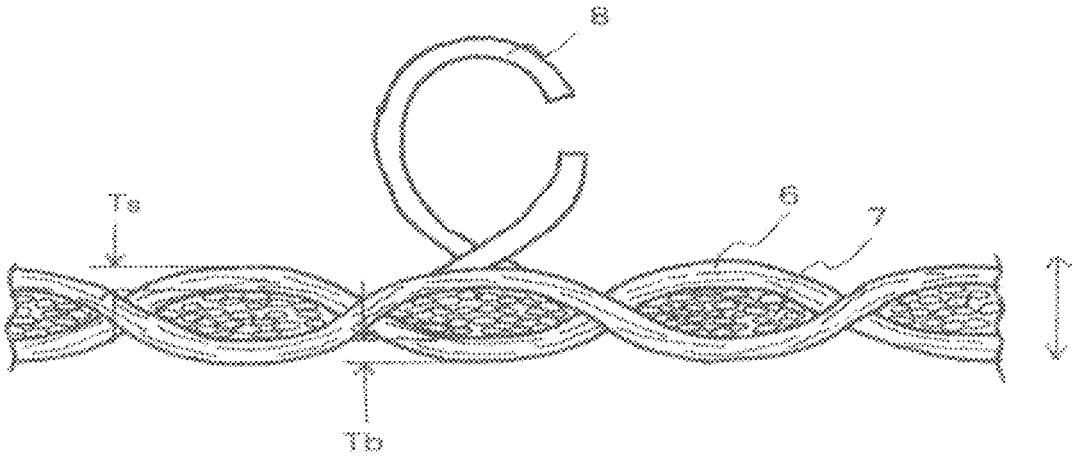
[Fig. 10]
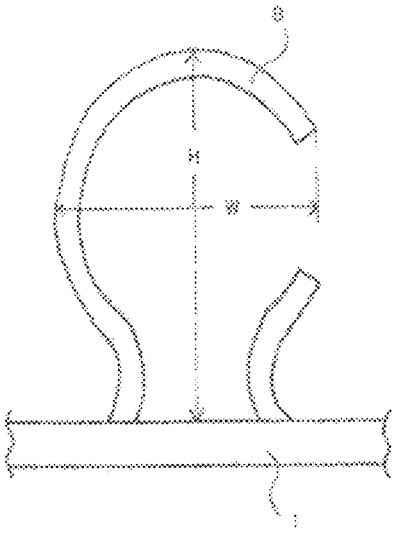

WOVEN FABRIC SURFACE FASTENER HAVING HOOK-SHAPED ENGAGING ELEMENT, AND METHOD FOR MANUFACTURING SAME

TECHNICAL FIELD

The present invention relates to a woven-fabric hook-and-loop fastener including a large number of hook-shaped engaging elements made of a polyethylene terephthalate-based monofilament yarn on a front face thereof, which provides a high engaging force and a gentle touch feeling when engaged with a hook-and-loop fastener including loop-shaped engaging elements, and a method for producing the same.

BACKGROUND ART

Conventionally, as a woven-fabric hook-and-loop fastener, a combination of a so-called woven-fabric type hook hook-and-loop fastener including a large number of hook-shaped engaging elements made of a monofilament yarn on the front face of a woven base fabric and a so-called woven-fabric loop hook-and-loop fastener including a large number of loop-shaped engaging elements made of a multifilament yarn capable of engaging with the hook-shaped engaging elements on the front face of a woven base fabric has been widely used in application fields such as clothes and daily sundries because the engaging elements are not damaged and the engaging force is less reduced even when engagement and separation are repeated.

In the case of such a woven-fabric hook-and-loop fastener (hereinafter, sometimes simply referred to as a hook-and-loop fastener), in order to prevent the yarn for the engaging elements woven into a woven base fabric (hereinafter, sometimes simply referred to as a base fabric) made of a warp yarn and a weft yarn from being pulled out from the base fabric by pulling at the time of separation of engagement, usually, a urethane-based or acrylic-based resin agent called a back coating adhesive is applied to the rear face of the base fabric, thereby fixing the yarn for the engaging elements to the base fabric.

However, when such a back coating adhesive is present on the rear face of the base fabric, there is a drawback that the flexibility of the base fabric is lost by the back coating-adhesive layer, the hook-and-loop fastener tends to be rigid, and the texture deteriorates, and in addition, there is also a drawback that the adhesive tends to deteriorate during use as a hook-and-loop fastener, the fixing force of the yarn for the engaging element gradually decreases, and the engaging function of the hook-and-loop fastener deteriorates. Further, there is also a drawback that the air permeability of the hook-and-loop fastener is reduced due to the back coating-adhesive layer existing on the rear face of the base fabric. In addition, since it takes time to evaporate and remove the solvent when the back coating adhesive liquid is applied, it is necessary to wind the woven base fabric once, which causes a decrease in productivity, and further causes a problem of deterioration of the working environment due to the evaporation and removal of the solvent.

Further, when the back coating adhesive is applied to the rear face of the base fabric, the woven-fabric hook-and-loop fastener cannot be dyed in a uniform and deep color because the dye liquid cannot penetrate the base fabric due to the back coating adhesive layer present on the rear face. Thus, it is necessary to perform the dyeing before the back coating adhesive is applied, and when the dyeing is performed before the back coating adhesive is applied, the yarns for the engaging element and the like are dyed in a state in which they are not fixed to the base fabric, so that the yarns constituting the base fabric are moved by the dyeing treatment, and the disordered shape and the disordered alignment of engaging elements are generated.

In particular, in the case in which the engaging elements are hook-shaped engaging elements, when the shape and arrangement of the engaging elements are disordered, at the time at which one leg of the loop for an engaging element is cut to form a hook-shaped engaging element, it is difficult to surely cut only one leg, and mixture of both legs that are cut and both legs that are not cut is present. The woven-fabric hook-and-loop fastener in which the arrangement of the engaging elements is disordered in this manner has a poor appearance, and further, when the mixture of the engaging elements in which both legs are cut and the engaging elements in which both legs are not cut is present, the engaging force is also deteriorated.

As a hook-and-loop fastener which solves the problem of the hook-and-loop fastener in which the back coating adhesive is applied to the rear face of the base fabric, PTL 1 discloses a woven-fabric hook-and-loop fastener made of a warp yarn, a weft yarn and a yarn for engaging elements that does not require a back coating adhesive, in which polyester-based heat-shrinkable yarns are used as the warp yarn, weft yarn and the yarn for engaging elements, a heat-fusible fiber is further used as the yarn constituting the weft yarn, and the yarn for the engaging elements are fixed to the base fabric by fusion of the heat-fusible fibers and heat shrinkage of the yarns constituting the hook-and-loop fastener.

In the case of the woven-fabric hook-and-loop fastener described in PTL 1, since the back coating adhesive layer does not exist, the drawback of the conventional hook-and-loop fastener provided with the back coating adhesive layer can be surely solved.

On the other hand, when a polyethylene terephthalate-based monofilament yarn, which is a representative polyester-based monofilament yarn, is used as the yarn for the hook-shaped engaging element, since the polyethylene terephthalate-based monofilament yarn is extremely rigid as compared with other polyester-based monofilament yarns, for example, a polybutylene terephthalate-based monofilament yarn. Thus, even when a loop for hook-shaped engaging elements is formed, the loop for the hook-shaped engaging elements is not formed in a laterally spread state but is formed in a longitudinally elongated state, and the loop shape tends to be non-uniform. As in the case of the hook-and-loop fastener provided with the back coating adhesive layer, when one leg of the loop for the engaging element is cut to form a hook-shaped engaging element, it is difficult to surely cut only one leg, and mixture of both legs that are cut and both legs that are not cut is present, resulting in a problem that a high engaging force cannot be obtained.

Further, when a polyethylene terephthalate-based monofilament yarn is used as the yarn for the hook-shaped engaging element, since the obtained hook-shaped engaging element has a longitudinally elongated hook shape, the number of loop fibers of the loop-shaped engaging element to be engaged with such a hook-shaped engaging element is small as compared with the case of the hook-shaped engaging element spread laterally, and also in this respect, the engaging force is poor. In addition, when the shape of the hook-shaped engaging elements is not uniform, the presence of a tall hook-shaped engaging element hinders the engagement of a short hook-shaped engaging element, so that the engaging force is also poor in this respect. Further, the longitudinally elongated hook-shaped engaging elements made of a rigid monofilament yarn have a problem that they are inferior in touch feeling and do not give a gentle touch feeling to the user.

When a nylon-based or a polyolefin-based monofilament yarn represented by polypropylene, which is widely used at present, is used as the monofilament yarn for the hook-shaped engaging element, since these monofilament yarns are flexible as compared with a polyethylene terephthalate-based monofilament yarn, a loop spread in the lateral direction is naturally formed, and the problem caused by the rigid monofilament yarn hardly occurs, and therefore, it can be said that the phenomenon is peculiar to the polyethylene terephthalate-based monofilament yarn.

PTL 2 describes that, in order to facilitate the formation of the loop for hook-shaped engaging elements when a woven-fabric hook-and-loop fastener is woven, a plurality of metal rods are placed parallel to warp yarns at positions at which the yarns for hook-shaped engaging elements run over the warp yarns, loops are formed by passing the yarns for the engaging element over the upper part of the metal rods, and the metal rods are pulled out from the loops after the loops are formed; when an artificial fiber is used as the yarn for the hook-shaped engaging elements, the loop shape can be maintained by heat treatment; and by having the cross-sectional shape of the metal rod of spread at the center part, since friction is reduced in the case of pulling out the loops from the metal rods, they are easily pulled out.

As for the loop formed by running over the metal rod and by utilizing the method described in PTL 2, in the case in which the metal rod has a cross-sectional shape spread at the center portion, when a polyethylene terephthalate-based rigid monofilament yarn is used as the yarn for the hook-shaped engaging element, the laterally spread loop shape at the center portion was formed. Further, since the laterally spread loop shape was fixed when the laterally spread loop shape was heated, when the metal rod is pulled out from the loop, the laterally spread loop shape is maintained and the loop height is expected to be uniform. However, in practice, it has been found that the loops from which the metal rods have been pulled out have variations in the angle of rise from the base fabric and the extent in the lateral direction and the longitudinal direction, and as a result, it is extremely difficult to surely cut one-leg-side portion of the loop to form a hook-shaped engaging element, and it is also extremely difficult to increase the engaging force of the hook hook-and-loop fastener to be obtained.

CITATION LIST

Patent Literature

PTL 1: WO2005/122817
PTL 2: JPS35-522

SUMMARY OF INVENTION

Technical Problem

An object of the present invention is to solve the problem that the angle of rise from a base fabric and the spread in the lateral direction and the longitudinal direction have vary, as a result of which, it is extremely difficult to surely cut one-leg-side part of a loop to form a hook-shaped engaging element and to increase the engaging force of a hook hook-and-loop fastener to be obtained; and that newly arises when the the method described in PTL 2 is used to solve the problem that it is difficult to obtain a hook-shaped engaging elements uniformly spread in the lateral direction, which is inevitably caused when a polyethylene terephthalate-based rigid monofilament yarn is used as a yarn for the hook-shaped engaging element.

Further, another object of the present invention is to provide a hook-and-loop fastener including hook-shaped engaging elements in which touch feeling is gentle since the hook-shaped engaging elements have a uniform height and spread in the lateral direction in spite of a rigid polyethylene terephthalate-based monofilament yarn, and further, in which appearance is excellent since the hook-shaped engaging elements having a uniform shape are arranged regularly and orderly.

Solution to Problem

That is, the present invention provides a woven-fabric hook-and-loop fastener including: a woven base fabric made of a warp yarn and a weft yarn, a yarn for hook-shaped engaging elements made of a polyethylene terephthalate-based monofilament yarn woven into the woven base fabric in parallel with the warp yarn, and a large number of the hook-shaped engaging elements formed of the yarn for the hook-shaped engaging elements and rising from a front face of the woven base fabric, on a front face side of the woven base fabric, in which a height of the hook-shaped engaging elements satisfies the condition (1) and a hook shape of the hook-shaped engaging elements satisfies the condition (2) described below:

(1) 90% or more of the hook-shaped engaging elements present on the front face of the woven base fabric have a height in a range of 0.975 to 1.025 times an average height (Ha) of the hook-shaped engaging elements, (2) 90% or more of the hook-shaped engaging elements present on the front face of the base fabric have a lateral-direction spread (W) of the hook-shaped engaging elements within a range of 0.7 to 0.8 times with respect to the height (H) of the hook-shaped engaging elements.

In addition, in the invention, it is preferable that the weft yarns contain a heat-fusible fiber, a base of the hook-shaped engaging elements is fixed to the woven base fabric by a fused product of the heat-fusible fiber, and the woven base fabric satisfies that a thickness of the warp yarns in a thickness direction of the woven base fabric at a position at which the warp yarns, which alternately run over and under the weft yarns with the weft yarns interposed therebetween, subduct most toward a rear face side is 0.94 times or less of the thickness at a position at which the warp yarns float most toward a front face side, and further, the woven base fabric satisfies that a thickness of the warp yarns in the base fabric thickness direction at the position at which the warp yarns subduct most toward the rear face side is in the range of 0.7 to 0.90 times the thickness at the position at which the warp yarns float most toward the front face side.

Further, preferably, in the invention, an average height (Ha) of the hook-shaped engaging elements is in a range of 1.45 to 1.65 mm, and an adhesive layer for fixing the hook-shaped engaging elements to the woven base fabric is not present on a rear face of the woven base fabric.

Further, the present invention provides a method for producing a woven-fabric hook-and-loop fastener including: weaving a loop woven-fabric by weaving a yarn for hook-shaped engaging elements made of a polyethylene terephthalate-based monofilament yarn in parallel with a warp yarn at a time of weaving a woven base fabric from the warp yarn and a weft yarn, and at the same time, regularly allowing the yarn for the hook-shaped engaging elements to run over the warp yarn, and raising the yarn for the hook-shaped engaging elements in a loop shape from a front face of the woven base fabric at a running-over position; subsequently fixing a rising part of a loop to the woven base fabric; and then cutting one leg of the loop fixed to form a hook-shaped engaging element from the loop, in which, at a time of weaving the loop woven-fabric, the Operations A to C as described below are performed in the order of A to B to C, and then the Step F as described below is performed:

[Operation A] an operation of, at the time of weaving the loop woven-fabric, arranging a plurality of rod-shaped bodies having a longitudinally elongated cross-sectional shape in parallel with the warp yarn such that a longitudinal direction is substantially perpendicular to the front face of the woven base fabric at a position at which the yarn for the hook-shaped engaging elements runs over the warp yarn, and forming a large number of the loops made of the yarn for the hook-shaped engaging elements on the front face of the woven base fabric by allowing the yarn for the hook-shaped engaging elements to run over the rod-shaped bodies;

[Operation B] an operation of heating the loop in a state in which the loop is running over the rod-shaped body at a position at which a cross-sectional shape of the rod-shaped body is a shape protruding in a lateral direction in the middle of the height (this heating treatment is referred to as a heat treatment I, and a region in which the heating treatment is performed is referred to as a heating region I) while sliding the loops on the rod-shaped bodies;

[Operation C] an operation of further sliding the loop on the rod-shaped body and pulling out the loop from the end of the tip of the rod-shaped body having a tapered shape;

[Step F] a step of cutting one leg of the loop to form the loop into a hook shape.

Further, it is preferable in such a production method that the shape of the rod-shaped body has a cross-sectional shape of an arc type protruding in a lateral direction in the middle of the height, a tapered shape of the tip portion of the rod-shaped body is also gradually tapered toward an end of the tip and tapered over a length in a range of 1 to 10 times a length in a longitudinal direction of the rod-shaped body such that an upper face and a lower face of the rod-shaped body approach a center portion in the longitudinal direction of the rod-shaped body, and the end of the tip is pointed, and the cross-sectional shape of the rod-shaped body is a shape that does not protrude in the lateral direction in a region of the [Operation A], in which only one side protrudes in the lateral direction in the region of the [Operation B], and that forms a tapered shape while maintaining a protruding shape in which only one side protrudes in the lateral direction at the tip portion, further, the height in the longitudinal direction of the cross-sectional shape of the rod-shaped body is constant up to right before the tip portion in the region in which the [Operation B] is performed, and a tensile force applied to the yarn for the hook-shaped engaging elements at the time of feeding the yarn for the hook-shaped engaging elements to weave the yarn for the hook-shaped engaging elements into the woven-fabric is in a range of 70 to 90 g/yarn, a tensile force applied to the warp yarn at the time of feeding the warp yarn is in a range of 40 to 60 g/yarn, and the tensile force applied to the yarn for the hook-shaped engaging elements is 15 to 40 g/yarn higher than the tensile force applied to the warp yarn.

Further, it is preferable that, in the production method of the present invention, the weft yarn contains a heat-fusible fiber, and the Steps D and E as described below are performed in this order on the loop woven-fabric after performing the Operation C and before performing the Step F;

[Step D] a step of guiding the loop woven-fabric to a heating region, heating to a temperature equal to or higher than a temperature at which the heat-fusible fiber is melted, and fixing the rising portion of the loop to the woven base fabric by a melt from the heat-fusible fiber (this heating treatment is referred to as a heat treatment II, and a region in which the heating treatment is performed is referred to as a heating region II);

[Step E] a step of taking out the woven-fabric obtained in the Step D from the heating region II, and pressing a rear face of the woven base fabric against a fixed face or a roll face in a state in which the heat-fusible fiber is melting.

Further, it is preferable that, in the production method in which the [Step D] and the [Step E] are additionally performed, the [Operation A] to the [Step E] are continuously performed without winding the woven-fabric in the middle, the [Step E] is performed by pressing only the rear face side of the woven base fabric without pressing the front face side of the woven base fabric against the fixed face or the roll face, and the [Operation A] to the [Step F] are continuously performed without winding the woven-fabric in the middle.

Advantageous Effects of Invention

In the present invention, when weaving the woven base fabric having the loop for hook-shaped engaging elements, with reference to the method described in PTL 2, the method including the followings is used; a plurality of rod-shaped bodies having a longitudinally elongated cross-sectional shape are used and arranged in parallel to the warp yarn such that the longitudinal direction is substantially perpendicular to the face of the woven base fabric at the position at which the yarn for the hook-shaped engaging elements runs over the warp yarn, a number of loops made of the yarn for the engaging elements are formed on the front face of the woven base fabric by allowing the yarn for the engaging elements to run over the rod-shaped body, the heat treatment I is performed in a state in which the yarn for the engaging elements runs over the rod-shaped body at a position at which the rod-shaped body has a cross-sectional shape protruding in the lateral direction in the middle of the height, the yarn for the engaging elements is heat-shrunk to bring the loops in close contact with the rod-shaped material, and the rod-shaped body is pulled out from the loop.

By using such a method, the loop formed by running over the rod-shaped body has a laterally spread loop shape at a position at which the rod-shaped body has a cross-sectional shape protruding laterally in the middle of the height, and further, the laterally spread loop shape is fixed by heating (heat treatment I). Therefore, even when the rod-shaped body is pulled out from the loop thereafter, it is expected that the laterally spread loop shape is maintained and the loop shape, in particular, the loop height is uniformized; however, in practice, in the case in which the yarn for the engaging elements is a polyethylene terephthalate-based monofilament yarn, the expected effect could not be obtained.

As a result of repeated studies on the cause, the present inventors have found that the shape of the rod-shaped tip portion at the time of pulling out the rod-shaped body from the loop has a great influence. That is, it has been found that the rod-shaped body vibrates vertically and horizontally due to the vibration generated during weaving and the reaction at the time of pulling out the loop from the tip of the rod-shaped body, the vibration is particularly large toward the tip portion of the rod-shaped body, when the tip portion of the rod-shaped body has a shape cut at a right angle in a direction perpendicular to the front face of the base fabric as shown in FIG. 5 of PTL 2, the loop shape is distorted in an upward direction or a lateral direction due to the vibration of the tip portion of the rod-shaped body, and further, the loop is prevented from standing upright from the front face of the base fabric.

Until the loop is pulled out from the rod-shaped body, the loop adheres to the rod-shaped body and is integrated with the rod-shaped body. However, when the loop is pulled out from the rod-shaped body or immediately before the loop is pulled out, the loop is not integrated with the rod-shaped body, and the movement of the loop is different from the vibration of the rod-shaped body. Thus, it is presumed that the loop shape is disordered by the movement of the tip portion of the rod-shaped body.

Of course, there is a method of cooling the loop well before pulling out the loop from the rod-shaped body to eliminate the influence of the vibration of the tip portion of the rod-shaped body. However, in this case, it is necessary to sufficiently separate the tip portion of the rod-shaped body from the heating region, that is, to increase the length of the rod-shaped body. When the rod-shaped body is longer, there is a tendency that the rod-shaped body vibrates harder and the shape of the loop for the engaging elements is destroyed, whereby the effect of the present invention cannot be obtained.

According to the present invention, when a polyethylene terephthalate-based monofilament yarn is used as a yarn for the hook-shaped engaging elements to produce a loop for an engaging elements that spreads in a lateral direction and has a uniform height, by using the rod-shaped body having a tapered tip portion as described above, the tip portion of the rod-shaped body does not break the loop shape, or does not incline or does not knock down the loop, when the loop is pulled out from the tip portion of the rod-shaped body.

When the loop for the hook-shaped engaging elements thus produced is subsequently subjected to the heat treatment II for fixing the loop for the hook-shaped engaging elements to the woven base fabric by melting the heat-fusible fiber, the loop shape is somewhat affected thereby, but since the loop does not bring in contact with an object in the heated state, the shape and upright state at the time when the rod-shaped body is pulled out are basically maintained, and the loop shape having a uniform height spread laterally is maintained.

The woven-fabric hook-and-loop fastener including the hook-shaped engaging elements formed from such a loop has a hook shape which spreads laterally, and the height thereof is made highly uniform, and as a result, the number of loop fibers of the loop-shaped engaging elements which enter hooks of the hook-shaped engaging elements increases, and the engaging force with the loop fastener is greatly improved. In addition, since it has a hook shape spread laterally and a uniform height, touch feeling is highly gentle. Further, since the hook-shaped engaging elements having a uniform shape are arranged regularly and orderly, the appearance is also excellent.

Further, in the present invention, as described above, it is preferable to use a method in which a yarn including a heat-fusible fiber is used as a weft yarn and the yarn is heat-fused by the heat treatment II in order to fix the loop for hook-shaped engaging elements to the woven base fabric. However, in the heat treatment II, it is preferable to take out the woven base fabric from the heating region II and press the rear face of the woven base fabric against the fixed face or the roll face while the feat-fusible fiber is melted, by this operation, the loop for the hook-shaped engaging elements subducted in the woven base fabric when a heat-fusible component of the weft yarn is fused is pressed from the rear face of the woven base fabric by the fixed face or the roll face pressed against the rear face of the woven base fabric, and as a result, the height of the hook-shaped engaging elements is further uniformized, and the engaging force with the loop fastener is further improved also from this point.

BRIEF DESCRIPTION OF DRAWINGS

FIG. 1 is a perspective diagram schematically showing a state after a heat treatment I when a woven-fabric hook-and-loop fastener of the present invention is woven.

FIG. 2 is a diagram schematically showing an example of a rod-shaped body used when the woven-fabric hook-and-loop fastener of the present invention is woven.

FIG. 3 is an enlarged diagram showing a cross-sectional shape of the rod-shaped body taken along X-X' shown in FIG. 2.

FIG. 4 is an enlarged diagram showing a cross-sectional shape of the rod-shaped body taken along Y-Y' shown in FIG. 2.

FIG. 5 is an enlarged diagram schematically showing a tip portion of an example of the rod-shaped body used when the woven-fabric hook-and-loop fastener of the present invention is woven.

FIG. 6 is an enlarged diagram of a rod-shaped body (metal rod) having a tip portion described in PTL 2.

FIG. 7 is a diagram schematically showing an example of a heat treatment apparatus in the heat treatment II suitably used in producing the woven-fabric hook-and-loop fastener of the present invention.

FIG. 8 is a diagram schematically showing a cross section in a plane parallel to the warp yarn of the woven base fabric when [Step E] is performed in one example of the woven-fabric hook-and-loop fastener of the present invention.

FIG. 9 is a diagram schematically showing a cross section in a plane parallel to the warp yarn of the woven base fabric of the woven-fabric hook-and-loop fastener when the [Step E] defined in the present invention is not performed.

FIG. 10 is a diagram schematically showing an example of a hook shape of a hook-shaped engaging element constituting the woven-fabric hook-and-loop fastener of the present invention.

DESCRIPTION OF EMBODIMENTS

Hereinafter, the present invention is described in detail. First, the woven-fabric hook-and-loop fastener of the present invention is a hook hook-and-loop fastener including a large number of hook-shaped engaging elements made of a monofilament yarn on a front face of a woven base fabric.

The hook hook-and-loop fastener is mainly formed of a monofilament yarn for a hook-shaped engaging element, a warp yarn and a weft yarn. As necessary, yarns other than these can be woven into the hook hook-and-loop fastener.

In the present invention, a polyethylene terephthalate-based monofilament yarn is used as the monofilament yarn for a hook-shaped engaging element. When the polyethylene terephthalate-based monofilament yarn is used, it is possible to obtain a hook-and-loop fastener that has excellent light resistance, collapse resistance for the engaging element, hook shape retainability, and shape stability against moisture absorption, further, that is excellent in adhesion to a polyester-based thermal adhesive, and further, that can be dyed simultaneously with a polyester fiber product since most of fibers used in an object such as clothes and daily sundries to which the hook-and-loop fastener is attached are polyester fibers. Further, since the woven-fabric hook-and-loop fastener after use can be recycled while being sewn and attached to the polyester fiber product, there is an advantage that it is environmentally friendly. On the other hand, when the conventional production method is used, as described above, there is a problem that the hook-shaped engaging elements longitudinally elongated and having non-uniform heights are inevitably formed and a high engaging force cannot be obtained. However, this problem and a method for solving thereof are described later.

In the present invention in which the polyethylene terephthalate-based monofilament yarn is used as the yarn for the hook-shaped engaging element, it is preferable to use a yarn substantially formed of a polyester-based polymer as each of the warp yarn and the weft yarn, from the viewpoint that waving (a state in which a face of the base fabric of the hook-and-loop fastener irregularly moves up and down and does not become a horizontal face) does not occur due to heat or water absorption or moisture absorption.

The polyester-based polymer is a polyester mainly including an ethylene terephthalate unit or a polyester mainly including a butylene terephthalate unit, and is a polyester obtained mainly by a condensation reaction of terephthalic acid and ethylene glycol or a condensation reaction of terephthalic acid and butanediol. Here, "including mainly" means that 50 mol % or more is included in the polyester.

A polymerization unit other than terephthalic acid and ethylene glycol or other than terephthalic acid and butanediol can be added in a small amount, as long as it is, for example, preferably less than 50 mol % in the polyester. Representative examples of such a polymerization unit include aromatic dicarboxylic acids such as isophthalic acid, sodium sulfoisophthalate, phthalic acid and naphthalenedicarboxylic acid; aliphatic or alicyclic dicarboxylic acids such as adipic acid, sebacic acid and cyclohexanedicarboxylic acid; diols such as propylene glycol, butanediol (in the case of a polyester mainly including an ethylene terephthalate unit), ethylene glycol (in the case of a polyester mainly including a butylene terephthalate unit), diethylene glycol and cyclohexanedimethanol; oxycarboxylic acids such as hydroxybenzoic acid and lactic acid; and monocarboxylic acids represented by acetic acid and benzoic acid. Further, a small amount of other polymers can be added to the polyester. The content of other polymers in the polyester is preferably 20 mol % or less, and more preferably 10 mol % or less.

Preferably, both the yarn for the hook-shaped engaging element and the warp yarn are formed of a polyethylene terephthalate homopolymer. Further, it is preferable that a polyethylene terephthalate-based polyester having a melting point which does not melt at the temperature of the heat treatment II for fusing a sheath component of a core-sheath type heat-fusible fiber constituting the weft yarn, which is described later, is a main component constituting the hook-shaped yarn for the engaging element and the warp yarn, from the viewpoint of performance, and further from the viewpoint that recycling use is possible. Here, "main component" means that 50 mol % or more is contained in the yarn constituting the yarn for the hook-shaped engaging element and the warp yarn.

In particular, in order to unify the hook shape of the hook-shaped engaging element into the shape defined in the present invention, the polyethylene terephthalate monofilament yarn used in the hook-shaped engaging element preferably has a dry-heat shrinkage percentage at 180° C. of 10 to 30%, and particularly preferably 15 to 25%. Note that the dry-heat shrinkage percentage referred to in the present invention is a value obtained using a measurement method specified in JIS L1013:2010.

In addition, as the yarn made of polyethylene terephthalate-based polyester used as the yarn for the hook-shaped engaging element and the warp yarn, a yarn made of recycled polyethylene terephthalate may be used, and in such a case, the effect of the present invention is more easily exhibited, which is preferable.

Describing this in detail, a polyethylene terephthalate-based fiber used in a conventional hook-and-loop fastener is obtained by polymerizing terephthalic acid and ethylene glycol, melting the obtained polyethylene terephthalate polymer, extruding the melted matter from a nozzle, and stretching the extruded matter in a predetermined manner, and a yarn made of such a fiber has an optimum degree of polymerization, crystal size, degree of crystallinity, crystal orientation and the like as a yarn and has uniform heat shrinkability. On the other hand, the recycled polyethylene terephthalate is obtained by collecting PET bottles and the like, after pulverizing them, melting them to form a sheet, pelletizing the sheet, and melt-spinning the pelletized resin. Thus, as for of the recycled polyethylene terephthalate, the degree of polymerization and the like are lowered or a crystallization-inhibiting substance is mixed, during the recycling process, that is, the pulverization, melting, pelletizing, and melt-spinning processes, so that the heat shrinkability tends to be unstable compared with yarns obtained from ordinary polyethylene terephthalate for the fiber.

As described above, when the polyethylene terephthalate-based monofilament yarn having unstable heat shrinkability is used as the hook-shaped engaging element, the hook hook-and-loop fastener obtained by the conventional and general method tends to be inferior in engaging force because the height of the hook-shaped engaging elements becomes uneven, the spread of the hooks in the lateral direction becomes insufficient, or the hook shape becomes uneven. However, when the present invention is used, even in the case of using such recycled polyethylene terephthalate, these problem are alleviated.

Further, as the warp yarn, a multifilament yarn made of 20 to 60 filaments and having a total decitex of 100 to 300 decitex is preferable, and a multifilament yarn made of 24 to 48 filaments and having a total decitex of 150 to 280 decitex is particularly preferable.

Furthermore, as the weft yarn, a multifilament yarn made of 10 to 72 filaments and having a total decitex of 80 to 30) decitex is preferred, and a multifilament yarn made of 18 to 56 filaments and having a total decitex of 90 to 260 decitex is particularly preferred.

In addition, the weft yarn preferably contains a heat-fusible fiber. Preferable representative examples of the heat-fusible fiber include a core-sheath type heat-fusible fiber including a sheath component as a heat-fusible component.

Since the weft yarn contains the heat-fusible fiber, the yarn for the hook-shaped engaging element can be firmly fixed to the base fabric, it is not necessary to apply a polyurethane-based or acryl-based back coating resin to the rear face of the base fabric of the hook-and-loop fastener in order to prevent the yarn for the hook-shaped engaging element from being pulled out from the base fabric as in the conventional hook-and-loop fastener, and the problem that the base fabric is rigid, which is the problem of the hook-and-loop fastener in which the yarn for the hook-shaped engaging element includes a polyethylene terephthalate-based resin, can be alleviated.

The yarn for the hook-shaped engaging element can be fixed to the base fabric by using a heat-fusible fiber as the warp yarn instead of the weft yarn. However, since the yarn for the hook-shaped engaging elements are threaded into the base fabric in parallel to the warp yarns, the warp yarns have far fewer points intersecting the yarn for the engaging elements than the weft yarns have, and therefore, when the heat-fusible fiber is used only as the warp yarn, it is difficult to firmly fix the yarn for the hook-shaped engaging element to the base fabric. Further, when the heat-fusible fiber is used as the warp yarn, it is difficult to keep the tensile force applied to the running base fabric constant in continuously producing the hook-and-loop fastener, and it tends to be difficult to stably and continuously produce the hook-and-loop fastener with a constant quality.

The core-sheath type heat-fusible fiber preferably includes a polyester-based resin, which is a resin capable of firmly fixing a base of the monofilament yarn for the hook-shaped engaging element to the base fabric by melting the sheath component, and examples thereof include a polyester-based fiber having a core-sheath type cross section in which the core component is not melted by the heat treatment II, but the sheath component is melted.

Specifically, a representative example thereof is a core-sheath type polyester fiber including polyethylene terephthalate as a core component, and including, as a sheath component, copolymerized polyethylene terephthalate in which a large amount of a copolymerization component represented by isophthalic acid, adipic acid, or the like is copolymerized, for example, copolymerized in an amount of 20 mol % to 30 mol %, to significantly reduce a melting point or a softening point. The melting point or softening point of the sheath component is preferably 100 to 250° C., more preferably 100 to 200° C., and is preferably 20 to 150° C. lower than the melting point of the warp yarn, the core component, or the monofilament yarn for the hook-shaped engaging element. The cross-sectional shape of the core-sheath type heat-fusible fiber may be a concentric core-sheath, an eccentric core-sheath, a single-core core-sheath, or a multi-core core-sheath.

Further, as for the proportion of the core-sheath type heat-fusible fibers in fibers constituting the weft yarn, particularly when all of the weft yarn is substantially formed of the core-sheath type heat-fusible fibers, that is, when the weft yarn is a multifilament yarn including a core-sheath type heat-fusible filament, the yarn for the hook-shaped engaging element is firmly fixed to the base fabric, which is preferable. In the case in which the fiber constituting the weft yarn does not have a core-sheath cross-sectional shape and the entire cross-section of the fiber is formed of a heat-fusible polymer, the heat-fusible polymer melted and solidified again is fragile and easily cracked, and in the case of sewing or the like, the base fabric is easily torn from a sewing thread portion. Therefore, the heat-fusible fiber preferably contains a resin that is not heat-fused, and preferably has a core-sheath cross-sectional shape including a core component made of a resin that is not heat-fused. Further, the weight ratio of the core component to the sheath component is preferably in a range of 20:80 to 80:20, and particularly preferably in a range of 55:45 to 75:25.

Further, in the present invention, the yarn constituting the hook-and-loop fastener itself is preferably heat-shrunk in the heat treatment II to fasten the base of the hook-shaped engaging element from both sides to firmly fix the yarn for the hook-shaped engaging element to the base fabric, and the monofilament yarn for the hook-shaped engaging element is preferably heat-shrunk in the heat treatment I to adhere to the rod-shaped body to make the loop height uniform; thus a fiber that undergoes heat shrinkage under heat treatment I is preferable. Specifically, a fiber having a dry-heat shrinkage percentage at 200° C. of 5 to 25%, or a fiber having a dry-heat shrinkage percentage at 180° C. of 10 to 30%, and particularly 15 to 25% is preferably used.

The hook-shaped engaging element constituting the hook hook-and-loop fastener is required to have so-called hook shape retainability in which the hook shape is not extended by alight force, and for this purpose, a thick monofilament yarn is used. In the present invention, as the monofilament yarn, a monofilament yarn which is formed of a polyethylene terephthalate-based polyester polymer particularly excellent in hook shape retainability and which includes a resin that does not melt in the heating zones I and II is used. As the thickness of such a monofilament yarn for hook-shaped engaging element, a diameter of 0.12 to 0.23 mm is preferable, and a diameter of 0.14 to 0.21 mm is more preferable, in view of stability of retention of the hook shape and ease of weaving.

A woven-fabric for the hook-and-loop fastener is firstly woven-fabric from the above-mentioned warp yarn, weft yarn and monofilament yarn for a hook-shaped engaging element. The weave structure of the woven is preferably a plain woven in which the monofilament yarn for hook-shaped engaging element is used as a part of the warp yarn, and the monofilament yarn for hook-shaped engaging element is woven in parallel to the warp yarn, rises from the face of the woven base fabric in the middle of the structure, runs over one to three threads, preferably three threads of warp yarns while forming a loop, and crawls in between the warp yarns. Such a weave structure is preferable because one leg side portion of the loop for the hook-shaped engaging element can be efficiently and surely cut, and further, the hook-shaped engaging element and the loop-shaped engaging element can be easily engaged with each other.

Further, in the method of the present invention, the following Operations A to C are performed in the order of the Operation A to the Operation B to the Operation C when the woven-fabric for the hook-and-loop fastener is woven.

[Operation A] an operation of, at the time of weaving the woven-fabric (loop woven-fabric) having a large number of loops for the hook-shaped engaging elements on the front face, arranging and placing a plurality of rod-shaped bodies having a longitudinally elongated cross-sectional shape in parallel with the warp yarn such that a longitudinal direction is substantially perpendicular to the face of the woven base fabric at a position at which the yarn for the hook-shaped engaging elements runs over the warp yarn, and forming a large number of the loops made of the yarn for the hook-shaped engaging elements on the front face of the woven base fabric by allowing the yarn for the hook-shaped engaging elements to run over the rod-shaped bodies,

[Operation B] an operation of heating in a state in which the yarn for the hook engaging elements runs over the rod-shaped body, at a position at which the cross-sectional shape of the rod-shaped body is a shape protruding in the lateral direction in the middle of the height (that is, heat treatment I).

[Operation C] an operation of sliding the loop on the rod-shaped body and pulling out the loop from the end of the tip of the rod-shaped body having a tapered shape.

That is, first, as a method for obtaining the woven-fabric hook-and-loop fastener including the hook-shaped engaging element of the present invention, a plurality of rod-shaped bodies having a longitudinally elongated cross-sectional shape are arranged and placed in parallel with the warp yarn such that the longitudinal direction is substantially perpendicular to the front face of the woven base fabric at a position at which the yarn for the hook-shaped engaging element runs over the warp yarn, thereby weaving to form the loop on the front face of the woven base fabric by allowing the yarn for the hook-shaped engaging element to run over the rod-shaped bodies (Operation A).

Next, the woven-fabric that was woven in the Operation A and has the loop for the hook-shaped engaging element on the front face thereof is slid along the rod-shaped body and then the Operation B is performed, that is, the woven-fabric is slid to a position at which the cross-sectional shape of the rod-shaped body is a shape protruding in the lateral direction in the middle of the height, and the heat treatment I is performed at this position in a state in which the yarn for the engaging element runs over the rod-shaped body. FIG. 1 schematically shows a preferable example of the woven-fabric passed through the Operation B, that is, a state in which the loop for the hook engaging element rising from the front face of the woven base fabric is heat-shrunk by the heat treatment I and the loop adheres to the rod-shaped body.

Note that, in FIG. 1, the rod-shaped body has a cross-sectional shape in which the shape protruding in the lateral direction in the middle of the height is a shape protruding in an arc shape in the lateral direction. However, at the time of weaving the woven base fabric (that is, at the time when the loop for the hook engaging element runs over the rod-shaped body), it is not necessary for the rod-shaped body to have a cross-sectional shape protruding in the lateral direction in the middle of the height, and it is rather preferable that the rod-shaped body does not protrude in the lateral direction in terms of ease of forming the loop.

In the method of the present invention, the rod-shaped body at the position at which the Operation B is performed needs to have a shape protruding in the lateral direction in the middle of the height in order to expand the loop in the lateral direction (an arc shape in FIG. 1), and the heat treatment I is performed in order to fix the loop shape in the shape protruding in the lateral direction (a heating apparatus for performing the heat treatment I is not shown in FIG. 1).

Then, [Operation C] described above is performed on the loop woven-fabric heat-treated in Operation B in a state in which the loop runs over the rod-shaped body, that is, an operation of sliding the loop on the rod-shaped body to move the loop to the end of the tip of the rod-shaped body in a tapered state and pulling out the loop from the end of the tip of the pointed rod-shaped body.

The rod-shaped body used in such [Operation A] to [Operation C] is preferably made of metal or ceramic, and the shape thereof is a shape as shown in FIG. 2 as an example, and the total length from the base portion (31) to the end of the tip of the tip portion (33) is preferably 10 to 60 cm. Further, the cross-sectional shape of the rod-shaped body is preferably such that the length is substantially the same as or slightly longer than the inner height of the loop for the hook-shaped engaging element immediately before the product (that is, the loop immediately before one leg is cut), and the width is slightly shorter than the width of the loop for the hook-shaped engaging element running over the warp yarn to form the loop. Specifically, considering that the yarn for the hook-shaped engaging element shrinks by heating, the length is preferably 100 to 140%, particularly preferably 110 to 130%, of the target height of the hook-shaped engaging element.

Further, as shown in FIG. 2, the rod-shaped body includes the base portion (31), a heat treatment portion (32), and the tip portion (33), and the base portion (31) is a region in which the [Operation A] is performed, the heat treatment portion (32) is a region in which the [Operation B] is performed, and the tip portion (33) is a region in which the [Operation C] is performed.

Among them, the cross-sectional shape of the rod-shaped body at the base portion (31) (the X-X' cross-sectional shape shown in FIG. 2) is preferably a longitudinally elongated rectangular shape as the cross-sectional shape shown in FIG. 3 and has a shape which does not protrude in the lateral direction in the middle of the height (that is, the longitudinal direction) from the viewpoint of ease of weaving. As shown in FIGS. 1 and 4, the cross-sectional shape (the Y-Y' cross-sectional shape shown in FIG. 2) of the rod-shaped body in the heat treatment portion (32) has a shape protruding in the lateral direction in the middle of the height (for example, the vicinity the center of the height). Specific examples of the shape protruding in the lateral direction in the middle of the height include a shape that protrudes in the lateral direction in the vicinity of the center of the height but does not protrude in the upper part and the lower part, such as a sharply bent type and a T type, in addition to the arc type as shown in FIGS. 1 and 4, and the arc type is preferable because the loop has a natural shape spreading in the lateral direction.

Specifically, a degree of protruding in the lateral direction at the heat treatment portion (32) is preferably protruding by 20 to 30% of the height (T) (that is, $100 \times P/T = 20$ to 30 as shown in FIG. 4). In the case of protruding to both sides in the middle of the height, the gap between the rod-shaped bodies becomes narrow, and the density of the hook-shaped engaging elements cannot be increased. Therefore, the rod-shaped body preferably protrudes to only one side as shown in FIGS. 1 and 4.

Further, the height of the rod-shaped body (the length in the longitudinal direction shown in FIGS. 4 and 5: T) is preferably in a range of 1.55 to 1.95 mm, and the rod-shaped body preferably have the same height at the base portion (31) and the heat treatment portion (32).

Further, it is preferable that the heat treatment portion (32) has the same height from the boundary part of the base portion (31) to the boundary part of the tip portion (33) in order to obtain the loop for engaging elements having uniform heights and in order to maintain the shape of the loop spread laterally. That is, it is preferable that the height in the longitudinal direction of the cross-sectional shape of the rod-shaped body has a constant height up to right before the tip portion in the region in which the Operation B is performed.

It is preferable that the length of the base portion (31) is 5 to 20 cm, and the length of the heat treatment portion (32) is 5 to 20 cm.

Further, the tip portion 33 of the rod-shaped body is required to have a tapered shape as shown in FIG. 5 so that the followings do not occur: when the rod-shaped body is pulled out from the loop for the hook-shaped engaging element, the end of the tip of the rod-shaped body vibrates and touches the pulled-out loop for the hook-shaped engaging element, and as a result, the well-arranged loop shape is broken, and the loop for the hook-shaped engaging element standing upright from the front face of the base fabric is inclined or fallen. Preferably, the tapered shape of the tip portion (33) of the rod-shaped body is linearly and gradually tapered toward the end of the tip such that the upper face and the lower face of the rod-shaped body approach the vicinity of the center portion in the longitudinal direction of the rod-shaped body over the length in a range of 1 to 10 times the longitudinal length (T shown in FIG. 5) of the rod-shaped body (LIT shown in FIG. 5 is 1 to 10), and the upper face and the lower face are brought in contact with each other at the end of the tip, and as a result, the end of the tip is pointed, and in this case, the loop for the hook-shaped engaging element can be highly prevented from being disordered by the vibration of the tip portion (33) of the rod-shaped body.

Further, the cross-sectional shape in the longitudinal direction of the tip portion (33) may extend to the end of the tip while maintaining a shape protruding in the lateral direction in the middle of the height as in the heat treatment portion (32), or may have a shape that does not protrude in the horizontal direction as in the base portion (31). Preferably, similarly to the heat treatment portion (32), the tip portion (33) extends to the end of the tip while maintaining a shape protruding in the lateral direction in the middle of the height. In this case, the vibration of the end of the tip of the rod-shaped body in the lateral direction can be reduced, and the effect of the present invention is further improved. In FIGS. 2 and 5, the shape of the tip portion in such a case is shown. The length of the tip portion (33) is preferably in a range of 1 to 10 mm, particularly preferably in a range of 2 to 8 mm. Of course, the boundary part between the tip portion (33) and the heat treatment portion (32) may be immediately tapered from the boundary part, or may be rounded and tapered. Further, it is not necessary for the end of the tip to be sharply pointed, and it may be slightly rounded.

The woven-fabric having the loop for the hook-shaped engaging element (2) on the front face woven by [Operation A] using such a rod-shaped body is slid with the loop running over the rod-shaped body and then [Operation B] described above is performed, that is, the woven-fabric is moved to the place (32) at which the cross-sectional shape of the rod-shaped body is a shape protruding in the lateral direction in the middle of the height, and heat treatment I is performed at this part (32) in a state in which the yarn for the engaging element runs over the rod-shaped body, to heat-shrink the yarn for the hook-shaped engaging element and preferably to adhere the loop to the rod-shaped body.

In the case in which the heat treatment I is not performed, when the yarn for the hook-shaped engaging element is a polyethylene terephthalate-based monofilament yarn, even when the run-over rod-shaped body has a cross-sectional shape protruding in the lateral direction in the middle of the height, the loop shape turns to a longitudinally elongated natural shape when the rod-shaped body is pulled out from the loop, and the hook hook-and-loop fastener of the present invention in which the hook-shaped engaging element spread in the lateral direction cannot be obtained. That is, it is necessary to heat the loop in a state in which the loop for the hook-shaped engaging element runs over the rod-shaped body having a cross-sectional shape protruding in the lateral direction in the middle of the height, and to fix the loop in a shape protruding in the lateral direction.

As a preferable heating method for the heat treatment I, a method in which the face of the woven-fabric on which the loop for hook-shaped engaging element is present is heated by a heater with a face temperature of 300 to 450° C. provided at a height of 2 to 10 cm above the rod-shaped body is preferably used. A specific heating temperature is about a temperature at which the face temperature of the upper face of the rod-shaped body is in a range of 80 to 120° C. More specifically, heating is preferably performed to a temperature about 5 to 50° C. higher than the glass transition temperature (about 75° C.) of polyethylene terephthalate forming the monofilament yarn for a hook-shaped engaging element. Further, it is preferable that the length of the heating region is 4 to 10 cm, and the heating time is in a range of 6 to 20 seconds. In the heat treatment I, since the loop for the hook-shaped engaging element is shrunk by heating to be brought in close contact with the rod-shaped body or to be shrunk to a state close thereto, it is not necessary to heat the warp yarn and weft yarn other than the loop, and it is not necessary to heat the yarn for the hook-shaped engaging elements other than the portion running over the rod-shaped body.

By this heat treatment I, the loop for the hook-shaped engaging element is substantially adhered to the rod-shaped body, the height is unified, and the loop shape is also unified into a shape along the cross-sectional shape of the rod-shaped body, that is, a shape along a shape protruding in the lateral direction in the middle of the height, that is, a loop shape spread in the lateral direction, and this loop shape is maintained even after passing through the next Operation C.

FIG. 1 shows a state of the woven-fabric after passing through the [Operation B] and before performing the [Operation C]. In FIG. 1, De represents a weft direction, and Da represents a warp direction. In FIG. 1, 1 represents the woven base fabric, 2 represents the loop for the hook-shaped engaging element, and 3 represents the rod-shaped body. From this figure, it can be seen that a plurality of the loops for the hook-shaped engaging element (2) rising from the front face of the woven base fabric (1) are arranged in parallel in the warp direction (Da) and run over the rod-shaped bodies (3) protruding in the lateral direction in the middle of the height, and the loops for the hook-shaped engaging element (2) adhere to the rod-shaped bodies (3) or in a state close thereto.

The woven-fabric having the loop for the hook-shaped engaging element having a uniform loop height and a uniform loop shape spread laterally, which is obtained in the [Operation B], is then subjected to [Operation C], that is, an operation of sliding the loop on the rod-shaped body and pulling out the loop from the end of the tip of the rod-shaped body having a tapered shape. At the point of pulling out the loop from the end of the tip of the rod-shaped body, the loop and the tip portion of the rod-shaped body are not in the state of being sufficiently cooled from the state of being heated in the heat treatment I. Therefore, when the loop is pulled out from the end of tip of the rod-shaped body in such a state, the loop after being pulled out touches the tip portion of the vibrating rod-shaped body and the loop shape spread laterally at a constant height that was formed with an effort is damaged, and in order to prevent such a situation, the tip portion (33) of the rod-shaped body is required to have a tapered shape as described above, and it is preferable that the tip portion is tapered and the end of the tip is pointed, as shown in FIG. 5. Thus, it is possible to prevent the loop pulled out from the end of the tip from being disordered by the vibration of the end of the tip due to the vibration of the rod-shaped body.

FIG. 6 shows a shape similar to that of the metal rod shown in FIG. 5 of PTL 2. However, when the tip portion is not tapered and the end of the tip is not pointed as shown in this figure, and the end of the tip is a cut face perpendicular to the front face of the woven base fabric, as described above, the vibrating end of the tip disorders the shape of the loop pulled out or knocks down the loop.

Note that it is preferable to continuously perform the [Operation A] to [Operation C] without winding the woven-fabric in the middle, in terms of workability and highly achieving the effect of the present invention. Further, the loop pulled out from the rod-shaped body is naturally cooled.

In this way, by performing [Operation A] to [Operation C] in the order of [Operation A] to [Operation B] to [Operation C], a woven-fabric including a loop for a hook-shaped engaging element having a uniform loop height and a uniform loop shape spread laterally is obtained. However, in order to further enhance the effect, it is preferable that the tensile force applied to the yarn for the hook-shaped engaging element at the time at which the yarn for the hook-shaped engaging element is fed for weaving the yarn for the hook-shaped engaging element into the woven-fabric is in a range of 70 to 90 g/yarn, the tensile force applied to the warp yarn when the warp yarn is fed is in a range of 40 to 60 g/yarn, and the tensile force applied to the yarn for the hook-shaped engaging element is 15 to 40 g/yarn higher than the tensile force applied to the warp yarn. By adjusting the yarn tensile force at the time of feeding in this way, the loop height and the loop shape can be more easily unified. Here, note that the tensile force applied to the yarn is a value measured using a fixed indicator, and is not a value obtained by measuring the running yarn using a handy indicator or the like.

In the present invention, it is preferable that the weave density of the warp yarns is from 35 to 80 threads/cm after the heat treatment II described later, and the weave density of the weft yarns is from 12 to 35 threads/cm after the heat treatment II. Further, the weight ratio of the weft yarn is preferably 20 to 40% with respect to the total weight of the yarn for the hook-shaped engaging element, the warp yarn, and the weft yarn constituting the hook-and-loop fastener.

In addition, in the hook hook-and-loop fastener of the present invention, the height of the hook-shaped engaging element, which is the height after one leg of the hook loop is cut, is preferably 1.45 to 1.65 mm, more preferably 1.48 to 1.63 mm, and particularly preferably 1.52 to 1.63 mm, from the front face of the woven base fabric, because a uniform height can be easily obtained, and as a result, an excellent engaging force can be obtained, and the hook-shaped engaging elements are less likely to fall.

Further, the density of the hook-shaped engaging elements in the hook hook-and-loop fastener is preferably in a range of 30 to 70 elements/$cm^2$ based on the portion of the woven base fabric in which the engaging elements are present and based on the area after the heat treatment II. Further, the tread count of monofilament yarns for the hook-shaped engaging element is about 2 to 5 threads, and particularly preferably 4 threads, with respect to 20 threads of warp yarns (including the monofilament yarns for hook-shaped engaging element).

In order to fix the loops for the hook-shaped engaging elements of the woven-fabric including the loop for the hook-shaped engaging element thus obtained (referred to as a loop woven-fabric) to the woven base fabric, generally, a step of applying a polyurethane-based or acryl-based back coating adhesive liquid to the rear face of the woven-fabric and drying is usually performed. However, in the present invention, instead of the operation of applying and drying the back coating adhesive liquid, the following Steps D and E are preferably performed in this order on the cooling loop woven-fabric after the [Operation C] is performed using the heat-fusible fiber contained in the weft yarn.

[Step D] a step of guiding the loop woven-fabric to a heating region, heating to a temperature equal to or higher than a temperature at which the heat-fusible fiber melts, and fixing the rising portion of the loop to the base fabric by a melt from the heat-fusible fiber (heat treatment II),

[Step E] a step of taking out the loop woven-fabric from the heating region and pressing the rear face of the woven base fabric against a fixed face or a roll face in a state in which the heat-fusible fiber is melting.

That is, the woven-fabric for the hook-and-loop fastener (loop woven-fabric) taken out from the [Operation C] is subjected to the heat treatment II by continuously running the woven-fabric (1) in a long state in a heat treatment furnace (4) as shown in FIG. 7, preferably without winding the fabric in the middle. By this heat treatment II, the sheath component of the core-sheath type heat-fusible fiber constituting the weft yarn is melted, and at the same time, the warp yarn, the yarn for the hook-shaped engaging element and the weft yarn are heat-shrunk to firmly fix the monofilament yarn for the hook-shaped engaging element to the woven base fabric. At this time, it is preferable that the long woven-fabric for the hook-and-loop fastener (1) running in the heat treatment furnace is allowed to run in a free state in the heat treatment furnace (4) without applying much tensile force and without bringing both the upper and lower faces of the long woven-fabric for the hook-and-loop fastener in contact with anything.

By the heat treatment II, the yarn for the hook-shaped engaging element is fixed to the woven base fabric, and the application of the back coating adhesive liquid and the drying treatment of the adhesive liquid, which have been performed in the conventional woven-based hook-and-loop fastener, is unnecessary, so that it is possible to prevent the problem in the process due to the back coating adhesive and the problem in the performance that the flexibility and the air permeability and liquid permeability of the hook-and-loop fastener are impaired. Further, the loop shape of the hook-shaped engaging element of the hook hook-and-loop fastener is completely fixed by the heat at the time of the heat treatment II, and even after one leg of the loop for the hook-shaped engaging element is cut to form the hook-shaped engaging element later, the hook shape is maintained and sufficient engaging strength can be obtained. Note that the shape of the loop for the hook-shaped engaging element has a uniform height and spreads laterally at the point of coming out of the [Operation C] due to the rod-shaped body, but the shape of the loop for the hook-shaped engaging element which has a uniform height and spreads laterally is not largely damaged by the heat treatment II performed thereafter.

The temperature at the time of the heat treatment II is generally 150 to 250° C., which is a temperature at which the heat-fusible fiber constituting the weft yarn is melted or soften but other yarns are not melted or not softened, and at which the polyethylene terephthalate-based monofilament yarn for the hook-shaped engaging element is fixed in a loop shape, and more preferably in a range of 175 to 215° C. when the hook-shaped engaging element is polyethylene terephthalate-based. As shown in FIG. 7, the heat treatment II is usually performed by running the woven-fabric for the hook-and-loop fastener (1) in a heated furnace (4) in a state in which the front face of the base fabric is not in contact with an object such as a roller or a guide, that is, in a non-contact state. When the front face of the base fabric is brought in contact with a roller, a guide, or the like in the furnace, the engaging element is pressed against the woven base fabric thereby, so that the engaging element standing upright from the front face of the woven base fabric cannot be obtained. Specifically, heat treatment II is completed by running so as to stay in the heat treatment oven (4) for 20 to 120 seconds at a speed of 0.30 to 1.30 m/minutes.

Next, when the woven-fabric for the hook-and-loop fastener subjected to the heat treatment II comes out from the heat treatment furnace (4), as shown in FIG. 7, the rear face of the woven base fabric is pressed against the fixed face or the roll face (5) in a state in which the heat-fusible fiber is kept molten. FIG. 7 shows a case in which an operation of pressing the rear face of the woven-fabric for the hook-and-loop fastener against the fixed face (5) is performed immediately after the fabric leaves the heat treatment furnace (4). In order to press only the rear face against the fixed face or the roll face (5), the rear face of the woven base fabric is brought in contact with the fixed face or the roll face (5) in a state with the tensile force. By this operation, the loop for the hook-shaped engaging elements subducted in the base fabric when the heat-fusible component of the weft yarn is fused is extruded from the rear face of the base fabric by the fixed face or the roll face pressed against the rear face of the base fabric, the height of the hook-shaped engaging elements is further uniformized, and the engaging force with the loop fastener is further improved.

Note that when the operation of pressing against the fixed face or the roll face (5) is performed (Step E), it is preferable that the front face side of the base fabric is not pressed against the fixed face or the roll face.

Further, it is preferable that the front and rear faces of the woven-fabric for the hook-and-loop fastener do not bring in contact with any solid object such as a roller or a guide until the rear face is pressed against the fixed face or the roll face (5) after entering into the heat treatment furnace (4), and the fixed face or the roll face with which the rear face brings in contact after leaving the heat treatment furnace is the first contact object.

In the present invention, the fixed face or the roll face (5) against which the rear face of the woven base fabric is pressed in a state in which the heat-fusible fiber is melted is preferably the face having a contact length with the rear face of the woven base fabric of 20 to 100 mm and a contact time of 2 to 10 seconds. Specific examples of the face as a preferable material include a fixed face or a roll face made of a metal, ceramics, or a heat-resistant resin. The face of the fixed face or the roll face can be a mirror-finished state, a satin-finished state, or slightly uneven as long as the face can press the rear face of the base fabric.

In the case of the fixed face, as shown in FIG. 7, it is preferable that the fixed face has such a shape that the running direction of the rear face of the woven-fabric is changed along the fixed face (5), because the effect is easily obtained. In FIG. 7, the running method of the woven-fabric for the hook-and-loop fastener (1) is changed by 90° along the fixed face (5).

Note that the fixed face or the roll face (5) is preferably heated to a temperature lower than the heat treatment temperature by 80 to 100° C. in order to enhance the contact effect, but usually, the face of the fixed face or the roll face (5) may be warmed by the residual heat of the woven base fabric (1) subjected to the heat treatment II and comes out from the heat treatment furnace. The face against which the rear face of the woven base fabric is pressed may be any of a face to which a face is fixed, a roll face in which a contact face rotates in accordance with the running of the woven base fabric, or a roll face with drive which actively pulls the woven base fabric. In addition, it may also be a guide-shaped narrow face.

In the present invention, as shown in FIG. 7, it is preferable that the woven base fabric (1) is run through the heat treatment furnace (4), the warp yarn and weft yarn are shrunk by the heat treatment furnace (4) as described above, then it comes out from the heat treatment furnace (4), and it is continuously run on the fixed face or the roll face (5). Thus, when pressed against the fixed or the roll face (5), the woven base fabric (1) is in a state in which the tensile force is applied in the warp direction. Preferably, as for the woven base fabric, the tensile force applied to the woven base fabric immediately after the woven base fabric passes through the fixed face or the roll face (8) is about 50 to 600 g/cm of the tensile force applied.

In the case of the woven-fabric-based hook-and-loop fastener of the present invention, the warp yarns alternately run over and under the weft yarns with the weft yarns interposed therebetween, so that the rear face of the woven base fabric is covered with the warp yarn, and the weft yarn in which the heat-fusible fiber is present is hardly brought in direct contact with the fixed face or the roll face. Therefore, the melt of the heat-fusible fiber does not directly attach to the face of the fixed face or the roll face, whereby the occurrence of the trouble is not also caused.

The operation of pressing the rear face of the woven-fabric for the hook-and-loop fastener (1) against the fixed face or the roll face (5) in a state in which the heat-fusible fiber used in the weft yarn is melted is preferably carried out by utilizing the residual heat at the time of the heat treatment II so as to be continued to the heat treatment II in the heat treatment oven (4) as shown in FIG. 7 without once cooling the woven-fabric for the hook-and-loop fastener subjected to the heat treatment II. However, after the woven-fabric for the hook-and-loop fastener is taken out from the heat treatment furnace (4) and once cooled, the rear face side of the woven base fabric is reheated to be in a state in which the heat-fusible fiber on the rear face side of the woven-fabric for the hook-and-loop fastener is melted, and the operation of pressing against the fixed face or the roll face (5) can be performed in this state.

By performing the operation [Step E] of pressing the rear face of the woven base fabric (1) against the fixed face or the roll face (5) in a state in which the heat-fusible fiber is melted, as shown in FIG. 8, it is preferable that the thickness (Tb) in the thickness direction of the base fabric at the position at which the warp yarn, which alternately runs over and under the weft yarn with the weft yarn interposed therebetween, subducts most toward the rear face is 0.94 times or less of the thickness (Ts) in the same direction at the position at which the warp yarn floats most toward the front face. More preferably, (Tb) is 0.92 times or less of (Ts), further preferably 0.90 times or less, and still further preferably 0.88 times or less.

Further, preferably, in the woven base fabric, the thickness (Tb) of the warp yarn in the thickness direction of the woven base fabric at a position subducting most toward the rear face side satisfies a range of 0.70 to 0.90 times the thickness (Ts) of the same at a position floating most toward the front face side.

It is preferable that (Tb) is 0.7 times or more, particularly 0.75 times or more, of (Ts), from the viewpoint that the rear face of the hook-and-loop fastener base fabric is densely flattened by heat fusion, and the flexibility, the texture, and further, the air permeability and the liquid permeability, which are advantages of a woven-fabric, are prevented from being impaired.

FIG. 8 schematically shows a cross-sectional state of the woven-fabric hook-and-loop fastener in which the effect of the present invention can be further obtained by pressing the rear face of the woven base fabric (1) against the fixed face or the roll face (5) in a state in which the heat-fusible fiber is melted, that is, a case in which (Tb) is 0.94 times or less of (Ts). On the other hand, FIG. 9 is a view schematically showing a cross-sectional state of the woven-fabric hook-and-loop fastener in the case in which the operation of pressing the rear face of the woven base fabric (1) against the fixed face or the roll face (5) in a state in which the heat-fusible fiber is melted is not performed, and in this case. (Tb) is substantially the same value as (Ts), and the (Tb)/(Ts) ratio does not satisfy 0.94 or less.

Note that even when the operation of pressing the rear face of the woven base fabric against the fixed face or the roll face in a state in which the heat-fusible fiber is melted, that is, [Step E], is not performed, a phenomenon in which the value of (Tb) is slightly smaller than the value of (Ts) due to the natural gravity to the hook-and-loop fastener during the process of producing the woven-fabric for the hook-and-loop fastener can occur, but the decrease is extremely slight, and (Tb) does not fall below 0.96 times (Ts).

Next, a method for measuring (Tb) and (Ts) of warp yarn alternately running over and under the weft yarn with the weft yarn interposed therebetween is described.

First, a region on the front face of which the engaging element is present and which is less influenced by the hook-shaped engaging elements is selected, and the hook-and-loop fastener is cut parallel to the warp yarn so as to cut the center portion of a bulge of the warp yarn by using a safety razor blade for shaving as a cutting apparatus. The resulting cross section is photographed with 200 times magnification. FIG. 8 schematically shows a photograph of the cut portion obtained as a result. From this photograph, three points at which the warp yarn subducts most toward the rear face side are arbitrarily selected, three points at which the warp yarn floats most toward the front face side are also arbitrarily selected, and the thicknesses in the thickness direction of the base fabric at the respective points are measured. The same measurement is performed at arbitrary 10 points of the hook-and-loop fastener, and the thicknesses of the base fabric in the thickness direction at the respective points are measured. Among the 30 measured values of the thickness in the thickness direction of the base fabric at the position subducts most toward the rear face side and the 30 measured values of the thickness of the base fabric in the thickness direction at the position floats most toward the front face side, 5 measured values in order from the highest value and 5 measured values in order from the lowest value are removed, and the average value of the remaining 20 values is obtained. The obtained average values are the warp thickness (Tb) in the thickness direction of the base fabric at the position at which the warp yarn subducts most toward the rear face side and the warp thickness (Ts) in the thickness direction of the base fabric at the position at which the warp yarn floats most toward the front face side.

Note that even when the woven-fabric for the hook-and-loop fastener is pressed against the fixed face or the roll face at the time when the heat-fusible resin of the warp yarn is kept in a molten state, not all the points of the warp yarns present on the rear face of the woven-fabric for the hook-and-loop fastener, which are most subducted to the rear face side, are pressed against the fixed face or the roll face. Among these, there is a point at which the thickness (Tb) of the rear face side of the warp yarn is hardly different from the thickness (Ts) of the front face side without being pressed against the fixed face or the roll face. In the present invention, such a position is also included in the arbitrarily selected positions. Therefore, it can be said that the (Tb)/(Ts) ratio specified in the present invention is an average value obtained by including these points.

On the other hand, FIG. 9 shows a diagram in which the woven-fabric for the hook-and-loop fastener is not pressed against the fixed face or the roll face as described above, in the case of FIG. 9, that is, in the case in which (Tb) and (Ts) have substantially the same value, the loop for the hook-shaped engaging element subducted into the base fabric when the heat-fusible component of the weft yarn is fused is not pressed from the rear face of the base fabric by the fixed face or the roll face pressed against the rear face of the base fabric, so that the effect of further uniformalizing the height of the hook-shaped engaging elements cannot be obtained.

In the present invention, the ratio of (Tb) to (Ts) depends mainly on the pressing strength at the time of pressing the woven-fabric for the hook-and-loop fastener base fabric against the fixed face or the roll face, and therefore the value of the ratio can be freely changed by running the woven-fabric for the hook-and-loop fastener base fabric on the fixed face or the roll face in a state with the tensile force and changing the running direction along the fixed face or the roll face as shown in FIG. 7.

Note that in the present invention, when the rear face of the woven-fabric for the hook-and-loop fastener base fabric is pressed against the fixed face or the roll face at the time at which the heat-fusible fiber constituting the weft yarn are kept in a molten state, it is preferable that the front face side of the woven-fabric for the hook-and-loop fastener base fabric on which the loop for the hook-shaped engaging element of the hook-and-loop fastener is present is not pressed against the fixed face or the roll face. That is, when the woven-fabric for the hook-and-loop fastener base fabric is sandwiched between rolls and the woven-fabric for the hook-and-loop fastener base fabric is pressed from above and below, the loop for the hook-shaped engaging element standing upright on the front face of the woven base fabric is pushed down by pressing from above and fixed to the front face of the woven base fabric in this state, so that the engaging ability as the hook-and-loop fastener is reduced and the appearance of the hook-and-loop fastener is also deteriorated. Further, when both of the front face side and the rear face side of the woven-fabric for the hook-and-loop fastener base fabric are pressed against the fixed face or the roll face, (Tb) and (Ts) become substantially equal to each other, and the (Tb)/(Ts) ratio defined in the present invention cannot satisfy 0.94 or less.

It is preferable to continuously perform the [Operation A] to [Operation E] without winding the woven-fabric in the middle in order to achieve workability and the effect of the present invention at a high level.

Next, the woven-fabric having the loop for hook-shaped engaging element obtained by the operation is subjected to the following [Step F]. Of course, the [Step D] and [Step E] are preferable steps and are not required steps, but the following [Step F] is a required step for forming the loop for hook-shaped engaging element into the hook-shaped engaging element.

[Step F] A step of cutting one leg of the loop to form the loop into a hook shape.

The cutting apparatus used for cutting one leg of the loop for the hook-shaped engaging element is preferably a cutting apparatus having a structure for cutting one leg of the loop for the hook-shaped engaging element of the woven base fabric for the hook-and-loop fastener running in the warp direction by reciprocating a movable cutting blade in a direction parallel to the base fabric between two fixed blades. Therefore, since the loop for the hook-shaped engaging element obtained in the present invention extends in the lateral direction (that is, the weft direction) by running over the rod-shaped body parallel to the warp yarn and being fixed in this state as described above, and further since the height of the loop is uniform, a specific place of one leg of the loop can be cut accurately and surely. Therefore, the problem that both legs of the loop are cut or both legs are not cut is solved.

Particularly, in the present invention, the resin constituting the hook-shaped engaging element is a polyethylene terephthalate-based resin, that is, a resin having extremely high hardness, usually, a loop extending in the longitudinal direction tends to be formed from such a hard resin, and in the case of the loop extending in the longitudinal direction, since both legs are close to each other, there is a problem that it is difficult to accurately and surely cut only one leg. According to the present invention, it is possible to form a laterally spread loop having a uniform height, and as a result, only one leg can be accurately and surely cut.

Further, in the present invention, it is preferable that the long polyester-based hook-and-loop fastener obtained after the completion of [Step F] is wound for the first time without being wound in the middle until [Operation A] to [Step F]. As a result, since the fastener is not wound up in the middle, the loop for the hook-shaped engaging element is not unevenly pressed, and also in this respect, the accurate cutting of only one leg is improved.

In the hook-and-loop fastener having the hook-shaped engaging element subjected to the [Operation A] to [Operation C] in this manner, the height of the hook-shaped engaging element satisfies the following condition (1), and the hook shape of the hook-shaped engaging element satisfies the following condition (2).

(1) 90% or more of the hook-shaped engaging elements present on the front face of the base fabric have a height in a range of 0.975 to 1.025 times the average height (Ha) of the hook-shaped engaging elements, (2) 90% or more of the hook-shaped engaging elements present on the front face of the base fabric have a lateral-direction spread (W) of the hook-shaped engaging elements in a range of 0.7 to 0.8 times a height (H) of the hook-shaped engaging elements.

Note that the expression "90% or more of the hook-shaped engaging elements" means "90 or more of 100 hook-shaped engaging elements".

Further, the height (H) of the hook-shaped engaging element and the lateral-direction spread (W) of the hook-shaped engaging element mean values shown in FIG. 10. That is, the height (H) of the hook-shaped engaging element is the vertical height from the front face of the woven base fabric to the top part of the hook-shaped engaging element, and the lateral-direction spread (W) of the hook-shaped engaging element is the distance outside the hook-shaped engaging element measured from the direction perpendicular to the loop face of the hook-shaped engaging element at the point at which the hook-shaped engaging element extends most laterally. Therefore, the height (H) of the hook-shaped engaging element is a low value when the hook-shaped engaging element is inclined or falls down.

As described above, in the hook-and-loop fastener including the hook-shaped engaging elements according to the present invention, the height of the hook-shaped engaging elements is unified, the hook-shaped engaging elements are largely spread in the lateral direction and are unified in the largely spread state. As a result, the number of the loop-shaped engaging elements to be engaged with the hook-shaped-based engaging elements is increased and the engaging force is improved, as compared with the conventional case in which the height of the hook-shaped engaging elements is not strictly unified and the spread in the lateral direction is not strictly unified. Preferably, 95% or more of the hook-shaped engaging elements have a height within a range of 0.975 to 1.025 times Ha, and 95% or more of the hook-shaped engaging elements satisfy 0.7 to 0.8 times W/H.

Regarding the uniformity of the height of the hook-shaped engaging elements, it has been conventionally considered that the uniformity is preferable from the viewpoint of the appearance of the hook-and-loop fastener. However, in the case of a conventional woven-fabric-based hook hook-and-loop fastener, at most, about 70% of the hook-shaped engaging elements satisfy the strict condition within a range of 0.975 to 1.025 times the average height (Ha) of the hook-shaped engaging elements specified in the present invention. In the present invention, the uniformity of the height of the hook-shaped engaging element is specified at a level much higher than the uniformity of the height of the conventional hook-shaped engaging element required in terms of appearance, and the uniformity of the height at the high level is satisfied. It has been surprisingly found that such a high level of height uniformity has a higher engaging force than those which meet conventional levels of height uniformity.

Further, according to the present invention, it has been found that a higher engaging force can be obtained by further increasing the spread in the lateral direction of the hook-shaped engaging element and unifying the spread in such a state.

Further, it has been found that although the hook-shaped engaging element is made of a rigid polyethylene terephthalate-based monofilament yarn, the hook-shaped engaging elements has a uniform height and spread in the lateral direction, so that the hook-shaped engaging element is gentle to the touch feeling, and further, the hook-shaped engaging elements having a uniform shape are arranged regularly and orderly, so that the hook-shaped engaging elements are much more excellent in appearance than the conventional ones.

The ratio of the height of the hook-shaped engaging element to the average height (Ha) of the hook-shaped engaging elements defined in the (1) and the lateral-direction spread (W) of the hook-shaped engaging element to the height (H) of the hook-shaped engaging elements defined in the (2) were determined by arbitrarily selecting 100 hook-shaped engaging elements present on the front face of the woven-fabric hook-and-loop fastener including hook-shaped engaging elements, determining the height (H) from the face of the woven base fabric and lateral-direction spread (W) of the selected 100 hook-shaped engaging elements by the following method, and determining H/Ha and W/H from the arithmetic average value (Ha) of the obtained H.

Measurement method of H and W: The base fabric in the vicinity of the base of an arbitrarily selected hook-shaped engaging element is cut parallel to the loop face of the hook-shaped engaging element, and as shown in FIG. 10, an enlarged photograph is taken from a direction perpendicular to the loop face, as for H, the distance from the front face of the base fabric to the uppermost part of the hook-shaped engaging element is measured, and as for W, the distance from the outside of the hook-shaped engaging element of the maximum spread portion of the loop portion to the outside is measured.

In the hook-and-loop fastener including the hook-shaped engaging elements obtained by performing the [Operation A] to the [Operation C], then performing the [Step D] to the [Step E], and further performing the [Step F], the heights of the hook-shaped engaging elements are unified at a higher level.

Further, in the present invention, the average height (Ha) of the polyethylene terephthalate-based hook-shaped engaging elements is more preferably in a range of 1.45 to 1.65 mm because a higher engaging force can be obtained.

The hook-and-loop fastener including the hook-shaped engaging elements thus obtained is then dyed with a disperse dye. At this time, since the base of the hook-shaped engaging element is fixed to the woven base fabric, the arrangement of the hook-shaped engaging elements is not disordered in the dyeing step, and further, the uniformity of the shape and height of the hook-shaped engaging elements is not impaired. Further, when an attachment object is made of a polyester fiber, dyeing can be performed at the same time after the attachment by sewing. Further, when the object to which the hook-and-loop fastener of the present invention is attached is a textile product made of a polyester fiber, for example, clothes, shoes or the like, the polyester can be recycled and reused in the attached state.

The hook hook-and-loop fastener of the present invention can be used in an application field in which a conventional general woven-fabric-based hook-and-loop fastener is used, it can be used in a wide range of fields, for example, clothes, blood pressure monitors, supporters, fixing belts, binding bands for packing, binding tapes, various toys, fixing of sheets for civil engineering and construction, fixing of various panels and wall materials, fixing of electric parts, storage boxes and packing cases which can be freely assembled and disassembled, small articles and curtains in addition to shoes, bags, hats, gloves and the like. In particular, the application fields in which a woven-fabric hook-and-loop fastener is attached to a fabric or sheet made of polyester-based fiber by sewing and then dying, for example, fields, such as clothes, shoes, bags, hats, gloves, and supporters are suitable.

EXAMPLES

Hereinafter, the present invention is described in more detail with reference to Examples. Note that the engaging force of the hook-and-loop fasteners of Examples and Comparative Examples was measured in accordance with JISL3416:2020. Further, at this time, B2790Y (manufactured by Kuraray Fastening Co., Ltd.) was used as a loop hook-and-loop fastener to be engaged.

Example 1

The following yarns were prepared as a warp yarn, a weft yarn, and a monofilament yarn for a hook-shaped engaging element constituting a woven base fabric of a hook hook-and-loop fastener.

[Warp Yarn]

Multifilament yarn made of polyethylene terephthalate having a melting point of 260° C.

Total decitex and number of filaments: 30 of 167 dtex

Dry-heat shrinkage percentage at 180° C.: 16%

[Weft Yarn (Multifilament-Based Heat-Fusible Yarn Made of Core-Sheath Composite Fiber)]

Core component: polyethylene terephthalate (melting point: 260° C.)

Sheath component: polyethylene terephthalate copolymerized with 25 mol % of isophthalic acid (softening point: 190° C.)

Core-sheath ratio (weight ratio): 70:30

Total decitex and number of filaments: 24 of 99 dtex

Dry-heat shrinkage percentage at 180° C.: 15%

[Monofilament Yarn for Hook-Shaped Engaging Element]

Polyethylene terephthalate fiber (melting point: 260° C.)

Fineness: 380 dtex (diameter: 0.19 mm)

Dry-heat shrinkage percentage at 180° C.: 18%

[Weaving of Hook Hook-and-Loop Fastener]

Using the warp yarn, weft yarn and monofilament yarn for hook-shaped engaging elements, a plain weave was used as a weave structure, and the monofilament yarn for hook-shaped engaging elements were threaded in parallel to the warp yarn at a ratio of one thread per four threads of warp yarn so as to have the weave density (after heat treatment II) of 55 threads of warp yarns/cm and 19 threads of weft yarns/cm, and so as to alternately run over and under the five threads of the weft yarn, and then to run over three threads of the warp yarn, thus a loop was formed on the base fabric at the running-over position. At this time, the rod-shaped bodies described below having the same number as the number of monofilament yarns for hook-shaped engaging elements to be woven in parallel with the warp yarns were arranged in parallel with the warp yarns at positions running over the warp yarns, and the monofilament yarns for hook-shaped engaging elements ran over the rod-shaped bodies to form loops for hook-shaped engaging elements. Note that the tensile force applied to the yarn for the hook-shaped engaging element at the time of feeding the yarn for the hook-shaped engaging element in order to weave the yarn for the hook-shaped engaging element into the woven-fabric was 75 g/yarn, and the tensile force of the warp yarn at the time of feeding the warp yarn was 55 g/yarn.

Further, in this case, the rod-shaped body to be run over by the yarn for hook-shaped engaging elements to form a loop is a stainless steel rod as shown in FIG. 2, and the entire length from the base portion (31) to the end of the tip of the tip portion (33) is 42 cm, the length of the heat treatment portion (32) is 6.5 cm, the length of the tip portion (33) is 0.5 cm, and the height (T shown in FIG. 5) from the base portion (31) to right before the tip portion (33) is 1.85 mm. As shown in FIG. 3, the base portion (31) has a cross-sectional shape which does not protrude laterally in the middle of the height, further, as shown in FIG. 4, the heat treatment portion (32) has a cross-sectional shape of an arc type which protrudes only in one lateral direction and protrudes 21% of the height (P=0.4 mm) at the most protruding portion in the lateral direction of the arc type, further, as shown in FIG. 5, the tip portion (33) is gradually tapered toward an end of the tip (L/T shown in FIG. 5 is 2.7) over a length in a range of 2.7 times the length in a longitudinal direction of the rod-shaped body (T shown in FIG. 5) such that the upper face and the lower face of the rod-shaped body approach the center portion in the longitudinal direction of the rod-shaped body, further, similar to the heat treatment portion (32), the tip portion (33) extends to the end of the tip while maintaining the shape protruding in the lateral direction in the middle of the height, and has the pointed shape of the end of the tip as shown in FIGS. 2 and 5.

The rod-shaped bodies are arranged in parallel with the warp yarns so that the longitudinal direction is substantially perpendicular to the base fabric face at a position at which the yarns for the hook-shaped engaging elements run over the warp yarns, and the yarn for the engaging elements runs over the base portion of the rod-shaped body to form a large number of loops made of the monofilament yarn for the hook-shaped engaging element on the front face of the base fabric. Further, the loop is slid on the rod-shaped body, and the front face side of the woven-fabric is heated by a heater of 350° C. such that the upper face of the rod-shaped body is 90° C. in a state in which the monofilament yarn for the hook-shaped engaging element runs over the rod-shaped body in the heat treatment portion (32) at which the cross-sectional shape of the rod-shaped body is an arc type, and the heat of the rod-shaped body is transmitted to the monofilament yarn for the hook-shaped engaging element running over the rod-shaped body, so that the temperature of the monofilament yarn is equal to or higher than the glass transition temperature. In this heated state, the loop woven-fabric was passed through a heating region having a length of 6.5 cm for 8 seconds to heat-shrink the monofilament yarn for hook-shaped engaging element to bring the loop in close contact with the rod-shaped body, and then slid on the rod-shaped body to pull out the loop from the pointed end of the tip of the rod-shaped body.

As shown in FIG. 7, the tape for the hook hook-and-loop fastener thus woven was then subjected to heat treatment II by running, with almost no tensile force applied for 55 seconds, in a heat treatment furnace at 210° C. at which only the sheath component of the weft yarn was thermally melted and the warp yarn, the yarn for the hook-shaped engaging element, and the core component of the weft yarn were not thermally melted, to shrink the warp yarn, the weft yarn, and the yarn for the hook-shaped engaging element. The tape was shrunk by 10% in the weft direction (total shrinkage percentage of the shrinkage in the heat treatment I), and the sheath component was melted to fuse the yarns existing in the vicinity thereof. Then, as shown in FIG. 7, while the heat-fusible fiber was maintained in a molten state, the woven-fabric tape for the hook hook-and-loop fastener was allowed to run along a fixed face of stainless steel having a mirror-finished front face placed in the immediate vicinity of the outlet of the heat treatment furnace in a state in which a tensile force of 200 g/cm applied after passing the fixed face, the rear face was pressed against the fixed face for 5 seconds, and the running direction was bent at 90 degree along the face. Then, the obtained woven-fabric was cooled, and one leg portion of the loop for the hook-shaped engaging element was cut to form a hook-shaped engaging element.

The obtained hook hook-and-loop fastener had a hook-shaped engaging element density of 42/cm$^2$, and the average height (Ha) of the hook-shaped engaging elements present on the front face of the base fabric was 1.52 mm, 98% of the hook-shaped engaging elements present on the front face of the base fabric were within a range of 0.975 to 1.025 times the average height (Ha) of the hook-shaped engaging elements, and, in 95% of the hook-shaped engaging elements, the lateral-direction spread (W) of the hook-shaped engaging elements with respect to the height (H) of the hook-shaped engaging element was within a range of 0.7 to 0.8 times. Further, each of the hook-shaped engaging elements was completely cut at a position of 65% of the height from the face of the base fabric, and the hook-shaped engaging elements in which one leg was not cut and maintained a loop shape, both legs were cut, and only the cross section of the monofilament yarn was cut up to the middle were not found.

Note that, from [Operation A] in which the woven-fabric was woven to [Operation B] in which the heat treatment I was performed in a state in which the loop for the hook-shaped engaging element ran over the rod-shaped body, to [Operation C] in which the loop was pulled out from the rod-shaped body, then to [Step D] in which the heat treatment II was performed, further to [Step E] in which the rear face was heat-pressure bonded, and further more to [Step F] in which one leg of the loop for the hook-shaped engaging element was cut, these were continuously performed without winding the tape for the hook hook-and-loop fastener in the middle, and the tape was wound for the first time after one leg of the loop for the hook-shaped engaging element was cut.

Further, as for the hook hook-and-loop fastener, the warp thickness (Tb) in the thickness direction of the base fabric at the position at which the warp yarn subducted most toward the rear face side and the warp thickness (Ts) in the thickness direction of the base fabric at the position at which the warp yarn floated most toward the front face side were measured. As shown in FIG. 9, (Tb) was 0.084 mm, and (Ts) was 0.100 mm, and therefore, (Tb)/(Ts) was 0.84.

Further, the engaging force of the hook hook-and-loop fastener was measured. The initial engaging force was 14.9 N/cm$^2$ in shear strength and 1.15 N/cm in peel strength, and the engaging force after 2000 engagements and peelings was 13.5 N/cm$^2$ in shear strength and 1.04 N/cm in peel strength, and it was found that the hook hook-and-loop fastener had extremely excellent engaging force.

Further, the obtained hook hook-and-loop fastener had a uniform height and spread in the lateral direction in spite of the hook-shaped engaging element made of the rigid polyethylene terephthalate monofilament yarn, so that the touch feeling of the front face of the hook-and-loop fastener was as gentle as that of a nylon hook-and-loop fastener, and further, the hook-shaped engaging elements having a uniform shape were regularly and orderly arranged, so that the hook hook-and-loop fastener was extremely excellent in appearance.

Comparative Example 1

In Example 1, a woven-fabric for a hook-and-loop fastener was woven in the same manner as in Example 1, except that the rod-shaped body in which the shape of the end of the tip of the rod-shaped body was not pointed and which had the shape with the tip thereof cut as same as the cross-sectional shape of the heat treatment portion (32) (that is, the same shape as that shown in FIG. 6) was used. Further, in the same manner as in Example 1, after the heat treatment II was performed (without performing the heat-pressure bonding of the rear face), one leg of the loop for a hook-shaped engaging element was cut to prepare a hook hook-and-loop fastener.

The average height (Ha) of the hook-shaped engaging elements present on the front face of the base fabric of the obtained hook hook-and-loop fastener was 1.54 mm, 86% of the hook-shaped engaging elements present on the front face of the base fabric were within a range of 0.975 to 1.025 times the average height (Ha) of the hook-shaped engaging elements, and nearly 20% of the hook-shaped engaging elements did not stand perpendicularly from the front face of the base fabric and were inclined or collapsed. In addition, a part of the hook-shaped engaging elements extended in the longitudinal direction or spread excessively in the lateral direction, and the hook-shaped engaging elements in which the lateral-direction spread (W) of the hook-shaped engaging elements with respect to the height (H) of the hook-shaped engaging elements was in a range of 0.7 to 0.8 times were 82% of all the hook-shaped engaging elements.

Further, the engaging force of this hook hook-and-loop fastener was measured. The initial engaging force was 8.9 N/cm$^2$ in shear strength and 0.65 N/cm in peel strength, and the engaging force after 2000 engagements and peelings was 8.0 N/cm$^2$ in shear strength and 0.62 N/cm in peel strength, and it was found that the values were about 40% inferior to those of the hook-and-loop fastener of Example 1. In addition, since the hook-shaped engaging elements were not uniform, the touch feeling and appearance of the hook-and-loop fastener were poor.

Comparative Example 2

In Example 1, a woven-fabric for a hook-and-loop fastener was woven in the same manner as in Example 1, except that the rod-shaped body in which the cross-sectional shape of the heat treatment portion (32) of the rod-shaped body was not a shape protruding laterally in the middle of the height but a rectangular shape perpendicular to the face of the base fabric from the root portion (31) to the end of the tip of the tip portion (33) was used. Further, in the same manner as in Example 1, after the heat treatment II was performed (without performing the heat-pressure bonding of the rear face), one leg of the loop for a hook-shaped engaging element was cut to prepare a hook hook-and-loop fastener.

The average height (Ha) of the hook-shaped engaging elements present on the front face of the base fabric of the obtained hook hook-and-loop fastener was 1.55 mm, 88% of the hook-shaped engaging elements present on the front face of the base fabric were within a range of 0.975 to 1.025 times the average height (Ha) of the hook-shaped engaging elements, most of the hook-shaped engaging elements had a shape extending in the longitudinal direction, and the hook-shaped engaging elements in which the lateral-direction spread (W) of the hook-shaped engaging elements was within a range of 0.7 to 0.8 times the height (H) of the hook-shaped engaging elements were only 60% of all the hook-shaped engaging elements. As a result, it was found that some of the hook-shaped engaging elements maintained a loop shape without cutting one leg, some were cut at both legs, and some were cut only to the middle of the cross section of the monofilament yarn.

Further, the engaging force of this hook hook-and-loop fastener was measured. The initial engaging force was 8.7 N/cm$^2$ in shear strength and 0.65 N/cm in peel strength, and the engaging force after 2000 engagements and peelings was 7.8 N/cm$^2$ in shear strength and 0.60 N/cm in peel strength, and it was found that the values were about 40% inferior to those of the hook-and-loop fastener of Example 1. In addition, since most of the hook-shaped engaging elements extended perpendicularly, the touch feeling of the hook-and-loop fastener was poor.

Comparative Example 3

In Example 1, a woven-fabric for a hook-and-loop fastener was woven in the same manner as in Example 1, except that heating was not performed with the loop for the hook-shaped engaging element running over the rod-shaped body (that is, heat treatment I was not performed), and the operation in which the rod-shaped body was simply run over and pulled out from the loop was performed. Further, in the same manner as in Example 1, after the heat treatment II was performed (without performing the heat-pressure bonding on the rear face), one leg of the loop for a hook-shaped engaging element was cut to prepare a hook hook-and-loop fastener.

The average height (Ha) of the hook-shaped engaging elements present on the front face of the base fabric of the obtained hook hook-and-loop fastener was 1.58 mm, 79% of the hook-shaped engaging elements present on the front face of the base fabric were within a range of 0.975 to 1.025 times the average height (Ha) of the hook-shaped engaging elements, most of the hook-shaped engaging elements had a shape extending in the longitudinal direction similarly to those of Comparative Example 2, and the hook-shaped engaging elements in which the lateral-direction spread (W) of the hook-shaped engaging elements was within a range of 0.7 to 0.8 times the height (H) of the hook-shaped engaging elements were only 72% of all the hook-shaped engaging elements. As a result, it was found that some of the hook-shaped engaging elements maintained a loop shape without cutting one leg, some were cut at both legs, and were cut only to the middle of the cross section of the monofilament yarn.

Further, the engaging force of this hook hook-and-loop fastener was measured. The initial engaging force was 8.8 N/cm$^2$ in shear strength and 0.64 N/cm in peel strength, and the engaging force after 2000 engagements and peelings was 7.9 N/cm$^2$ in shear strength and 0.59 N/cm in peel strength, and it was found that the values were about 40% inferior to those of the hook-and-loop fastener of Example 1 as in Comparative Example 2. In addition, since the hook-shaped engaging elements extended perpendicularly, the touch feeling of the hook-and-loop fastener was poor.

Example 2

In Example 1, a hook hook-and-loop fastener was prepared in the same manner as in Example 1, except that the [Step E] of heat-pressure bonding the rear face immediately after the heat treatment II was not performed, and after the heat treatment II was performed, a method in which the weft yarn was sufficiently cooled and then taken up by a roller was used instead.

The hook-shaped engaging element density of the obtained hook hook-and-loop fastener was the same as that of Example 1. Further, the average height (Ha) of the hook-shaped engaging elements present on the base fabric was 1.50 mm, which was slightly lower than that of Example 1. In addition, 96% of the hook-shaped engaging elements present on the front face of the base fabric were within a range of 0.975 to 1.025 times the average height (Ha) of the hook-shaped engaging elements, and in 92% of the hook-shaped engaging elements, the lateral-direction spread (W) of the hook-shaped engaging elements with respect to the height (H) of the hook-shaped engaging elements was within a range of 0.7 to 0.8 times.

Most of the hook-shaped engaging elements of the obtained hook hook-and-loop fastener were cut at a position of 70% of the height from the face of the base fabric, and those in which one leg was not cut and maintained a loop shape, both legs were cut, and the monofilament yarn was cut only to the middle of the cross section were not seen at first glance. However, when the front face was observed in detail using a magnifying lens, although in small number, those in which one leg of the hook-shaped engaging element was not completely cut and the hook-shaped engaging element was not formed and those in which one leg was not cut and the hook-shaped engaging element was not formed were found.

Further, as for the hook hook-and-loop fastener, the warp thickness (Tb) in the thickness direction of the base fabric at the position at which the warp yarn subducted most toward the rear face side and the warp thickness (Ts) in the thickness direction of the base fabric at the position at which the warp yarn floated most toward the front face side were measured. As shown in FIG. 9, (Tb) was 0.096 mm, and (Ts) was 0.100 mm, and therefore, (Tb)/(Ts) was 0.96, and there was only a slight difference in the warp thickness the rear face side compared to that of the front face side.

The engaging force of this hook hook-and-loop fastener was measured. The initial engaging force was 14.5 N/cm$^2$ in shear strength and 1.10 N/cm in peeling strength, and the engaging force after 2000 engagements and peelings was 13.0 N/cm$^2$ in shear strength and 10.0 N/cm in peeling strength, and it was found that the hook hook-and-loop fastener had an excellent engaging force as a hook-and-loop fastener although it was slightly inferior to that of Example 1 overall. Since the hook-shaped engaging elements of the obtained hook hook-and-loop fastener had a uniform height and spread in the lateral direction, the touch feeling of the front face of the hook-and-loop fastener was as gentle as that of Example 1, and further, since the hook-shaped engaging elements having a uniform shape were regularly and orderly arranged, the hook-face fastener was excellent in appearance.

Example 3

A hook hook-and-loop fastener was produced in the same manner as in Example 1, except that the rod-shaped body used in Example 1 was replaced with a stainless steel rod-shaped body (otherwise the same to that used in Example 1) having a cross-sectional shape of a length of 1.80 mm and a width of 0.2 mm, having a sharply bent type cross-sectional shape in the heat treatment I portion, and protruding by 0.2 mm in the most laterally protruding portion (P=0.2 mm), and, in the heat treatment I, the temperature of a heater used for heating the front face side of the woven-fabric in a state in which the yarn for the hook-shaped engaging element runs over the rod-shaped body was 320° C., and the upper face of the rod-shaped body was heated to 85° C. by the heater.

The average height (Ha) of the hook-shaped engaging elements present on the front face of the base fabric of the obtained hook hook-and-loop fastener was 1.51 mm, 97% of the hook-shaped engaging elements present on the front face of the base fabric were within a range of 0.975 to 1.025 times the average height (Ha) of the hook-shaped engaging elements, and, in 93% of the hook-shaped engaging elements, the lateral-direction spread (W) of the hook-shaped engaging elements with respect to the height (H) of the hook-shaped engaging elements was within a range of 0.7 to 0.8 times. Further, all of the hook-shaped engaging elements were completely cut at a position of 68% of the height from the face of the base fabric, and the hook-shaped engaging elements in which one leg was not cut and maintained a loop shape, both legs were cut, and only to the middle of the cross section of the monofilament yarn was cut were not found.

Further, as for the hook hook-and-loop fastener, the warp thickness (Tb) in the thickness direction of the base fabric at the position at which the warp yarn subducted most toward the rear face side and the warp thickness (Ts) in the thickness direction of the base fabric at the position at which the warp yarn floated most toward the front face side were measured. As shown in FIG. 9, (Tb) was 0.088 mm, and (Ts) was 0.100 mm, and therefore, (Tb)/(Ts) was 0.88.

Further, the engaging force of this hook hook-and-loop fastener was measured. The initial engaging force was 14.8 N/cm$^2$ in shear strength and 1.12 N/cm in peel strength, and the engaging force after 2000 engagements and peelings was 13.3 N/m$^2$ in shear strength and 1.02 N/cm in peel strength, and it was found that the hook hook-and-loop fastener had extremely excellent engaging force as a hook-and-loop fastener. Further, although the hook shape of the hook-shaped engaging element was slightly deformed as compared with that of Example 1, the touch feeling and appearance were not largely inferior to those of Example 1.

Example 4

A hook hook-and-loop fastener was prepared in the same manner as in Example 1, except that the monofilament yarn for the hook-shaped engaging elements used in Example 1 was replaced with the following monofilament yarn, and the rod-shaped body used was changed to a stainless steel rod-shaped body having a cross-sectional shape of a length of 1.80 mm and a width of 0.2 mm similar to Example 3, having a sharply bent type cross-sectional shape in the heat treatment I portion similar to Example 3, and protruding by 0.2 mm in the most laterally protruding portion (P=0.2 mm), and, in the heat treatment I, the temperature of a heater used for heating the front face side of the woven-fabric in a state in which the yarn for the hook-shaped engaging element ran over the rod-shaped body was 300° C., and the upper face of the rod-shaped body was heated to 80° C. by the heater.

[Monofilament Yarn for Hook-Shaped Engaging Element]

Polyethylene terephthalate fiber (melting point: 260° C.)

Fineness; 450 dtex (diameter: 0.21 mm)

Dry-heat shrinkage percentage at 180° C.: 18%

The average height (Ha) of the hook-shaped engaging elements present on the front face of the base fabric of the obtained hook hook-and-loop fastener was 1.54 mm, 97% of the hook-shaped engaging elements present on the front face of the base fabric were within a range of 0.975 to 1.025 times the average height (Ha) of the hook-shaped engaging elements, and in 93% of the hook-shaped engaging elements, the lateral-direction spread (W) of the hook-shaped engaging elements with respect to the height (H) of the hook-shaped engaging elements was within a range of 0.7 to 0.8 times. Further, all of the hook-shaped engaging elements were completely cut at a position of 67% of the height from the face of the base fabric, and the hook-shaped engaging elements in which one leg was not cut and maintained a loop shape, both legs were cut, and only to the middle of the cross section of the monofilament yarn was cut were not found. Further, although the hook shape of the hook-shaped engaging element was slightly deformed as compared with that of Example 1, the touch feeling and the appearance were not largely inferior to those of Example 1.

As for the hook hook-and-loop fastener, the warp thickness (Tb) in the thickness direction of the base fabric at the position at which the warp yarn subducted most toward the rear face side and the warp thickness (Ts) in the thickness direction of the base fabric at the position at which the warp yarn floated most toward the front face side were measured. As shown in FIG. 9, (Tb) was 0.086 mm, (Ts) was 0.100 mm, and therefore, (Tb)/(Ts) was 0.86. Further, the engaging force of this hook hook-and-loop fastener was measured. The initial engaging force was 17.8 N/cm$^2$ in shear strength and 1.38 N/cm in peeling strength, and the engaging force after 2000 engagements and peelings was 13.8 N/cm$^2$ in shear strength and 1.10 N/cm in peeling strength, and it was found that the hook hook-and-loop fastener had extremely excellent engaging force as a hook-and-loop fastener.

Example 5

A hook hook-and-loop fastener was prepared in the same manner as in Example 1, except that a rod-shaped body in which the cross-sectional shape of the heat-treated portion I was an arc type protruding only in one lateral direction, and the most protruding portion in the lateral direction of the arc type protruded much more than that used in Example 1 by 0.6 mm (P=0.6 mm) was used instead of the rod-shaped body used in Example 1.

The average height (Ha) of the hook-shaped engaging elements present on the front face of the base fabric of the obtained hook hook-and-loop fastener was 1.51 mm, which was slightly lower than that of Example 1. In addition, 94% of the hook-shaped engaging elements present on the front face of the base fabric were within a range of 0.975 to 1.025 times the average height (Ha) of the hook-shaped engaging elements, and 91% of the hook-shaped engaging elements were within a range of 0.7 to 0.8 times the lateral-direction spread (W) of the hook-shaped engaging elements with respect to the height (H) of the hook-shaped engaging elements. Further, all of the hook-shaped engaging elements were completely cut at a position of 60% of the height from the face of the base fabric, and the hook-shaped engaging elements in which one leg was not cut and maintained a loop shape, both legs were cut, and only to the middle of the cross section of the monofilament yarn was cut were not found.

As for the hook hook-and-loop fastener, the warp thickness (Tb) in the thickness direction of the base fabric at the position at which the warp yarn subducted most toward the rear face side and the warp thickness (Ts) in the thickness direction of the base fabric at the position at which the warp yarn floated most toward the front face side were measured. As shown in FIG. 9, (Tb) was 0.084 mm, (Ts) was 0.100 mm, and therefore, (Tb)/(Ts) was 0.84.

Further, the engaging force of this hook hook-and-loop fastener was measured. The initial engaging force was 14.0 N/cm$^2$ in shear strength and 1.08 N/cm in peel strength, and the engaging force after 2000 engagements and peelings was 13.0 N/m$^2$ in shear strength and 0.96 N/cm in peel strength, and it was found that the hook hook-and-loop fastener had extremely excellent engaging force as a hook-and-loop fastener. Further, although the hook shape of the hook-shaped engaging element was spread in the lateral direction as compared with that of Example 1, the touch feeling and the appearance were equal to those of Example 1.

Example 6

A hook hook-and-loop fastener was prepared in the same manner as in Example 1, except that a rod-shaped body in which the cross-sectional shape of the heat-treated portion I was an arc type protruding only in one lateral direction, and the most protruding portion in the lateral direction of the arc type was smaller than that used in Example 1 and protruded by 0.2 mm (P=0.2 mm) was used instead of the rod-shaped body used in Example 1.

The average height (Ha) of the hook-shaped engaging elements present on the front face of the base fabric of the obtained hook hook-and-loop fastener was 1.53 mm, which was slightly higher than that of Example 1. In addition, 92% of the hook-shaped engaging elements present on the front face of the base fabric were within the range of 0.975 to 1.025 times the average height (Ha) of the hook-shaped engaging elements, and in 92% of the hook-shaped engaging elements, the lateral-direction spread (W) of the hook-shaped engaging elements with respect to the height (H) of the hook-shaped engaging elements was within the range of 0.7 to 0.8 times. Further, although most of the hook-shaped engaging elements were completely cut at a position of 64% of the height from the face of the base fabric, a very small number of hook-shaped engaging elements in which a loop shape was maintained without being cut, both legs were cut, and only to the middle of the cross section of the monofilament yarn was cut were observed.

As for the hook hook-and-loop fastener, the warp thickness (Tb) in the thickness direction of the base fabric at the position at which the warp yarn subducted most toward the rear face side and the warp thickness (Ts) in the thickness direction of the base fabric at the position at which the warp yarn floated most toward the front face side were measured. As shown in FIG. 9, (Tb) was 0.084 mm, (Ts) was 0.100 mm, and therefore, (Tb)/(Ts) was 0.84.

Further, the engaging force of this hook hook-and-loop fastener was measured. The initial engaging force was 15.1 N/cm$^2$ in shear strength and 1.12 N/cm in peel strength, and the engaging force after 2000 engagements and peelings was 13.8 N/m$^2$ in shear strength and 1.02 N/cm in peel strength, and it was found that the hook hook-and-loop fastener had an excellent engaging force as a hook-and-loop fastener although these were slightly inferior to that of Example 1. Further, although the hook shape of the hook-shaped engaging element was elongated in the longitudinal direction as compared with that of Example 1, the touch feeling and the appearance were almost equal to those of Example 1.

Reference Examples 1 to 4

A hook hook-and-loop fastener was prepared in the same manner as in Example 1 except that the yarn for the hook-shaped engaging element of Example 1 was changed to the following monofilament yarn made of polybutylene terephthalate, and the temperature of the heat treatment II was changed to 190° C. (Reference Example 1).

[Monofilament Yarn for Hook-Shaped Engaging Element]

Polybutylene terephthalate fiber (melting point: 225° C.)

Fineness: 330 dtex (diameter: 0.18 mm)

Dry-heat shrinkage percentage at 180° C.: 13%

In Reference Example 1, a hook hook-and-loop fastener was prepared in the same manner as in Reference Example 1, except for performing at room temperature without heating in the heat treatment I (Reference Example 2).

Further, in Reference Example 1, a hook hook-and-loop fastener was prepared in the same manner as in Reference Example 1, except that a rod-shaped body in which the shape of the end of the tip of the rod-shaped body was not pointed and was the same shape as the cross-sectional shape of the heat treatment portion (32), and the tip was cut (that is, the same shape as in FIG. 6) was used and heating was performed in the heat treatment I (Reference Example 3).

Further, in Reference Example 1, a hook hook-and-loop fastener was prepared in the same manner as in Reference Example 1 except that a rod-shaped body in which the cross-sectional shape of the heat treatment portion (32) of the rod-shaped body was not a shape protruding in the lateral direction in the middle of the height and the cross-sectional shape from the base portion (31) to the end of the tip of the tip portion (33) was a rectangular shape perpendicular to the face of the base fabric was used (Reference Example 4).

The average height (Ha) of the hook-shaped engaging elements present on the front face of the base fabric of the obtained hook hook-and-loop fastener was 1.42 mm in Reference Example 1, 1.44 mm in Reference Example 2, 1.43 mm in Reference Example 3, and 1.43 mm in Reference Example 4. In addition, 96% of the hook-shaped engaging elements present on the front face of the base fabric in the case of Reference Example 1, 97% of the hook-shaped engaging elements present on the front face of the base fabric in the case of Reference Example 2, 96% of the hook-shaped engaging elements present on the front face of the base fabric in the case of Reference Example 3, and 95% of the hook-shaped engaging elements present on the front face of the base fabric in the case of Reference Example 4 were within a range of 0.975 to 1.025 times the average height (Ha) of the hook-shaped engaging elements.

In 92% of the hook-shaped engaging elements present on the front face of the base fabric, the lateral-direction spread (W) of the hook-shaped engaging elements with respect to the height (H) of the hook-shaped engaging elements was 0.7 to 0.8 times in the case of Reference Example 1, in 94% of the hook-shaped engaging elements present on the front face of the base fabric, the lateral-direction spread (W) of the hook-shaped engaging elements with respect to the height (H) of the hook-shaped engaging elements was 0.7 to 0.8 times in the case of Reference Example 2, in 93% of the hook-shaped engaging elements present on the front face of the base fabric, the lateral-direction spread (W) of the hook-shaped engaging elements with respect to the height (H) of the hook-shaped engaging elements was 0.7 to 0.8 times in the case of Reference Example 3, and in 90% of the hook-shaped engaging elements present on the front face of the base fabric, the lateral-direction spread (W) of the hook-shaped engaging elements with respect to the height (H) of the hook-shaped engaging elements was 0.7 to 0.8 times in the case of Reference Example 4. It was found that the hook-shaped engaging elements sufficiently spread laterally regardless of the shape of the rod-shaped body, regardless of the presence or absence of heating in the heat treatment I, and further regardless of the shape of the tip portion of the rod-shaped body, that is, the case in which the monofilament yarn for the hook-shaped engaging elements was made of polybutylene terephthalate was completely different from the case in which it was made of polyethylene terephthalate.

Further, in each of the hook-and-loop fasteners of Reference Examples 1 to 4, it was found that most of the hook-shaped engaging elements were cut at a position of about 65% of the height from the face of the base fabric, but some were not cut and maintained a loop shape, some were cut at both legs, and some were cut only to the middle of the cross section of the monofilament yarn, and when the monofilament yarn for the hook-shaped engaging element was made of polybutylene terephthalate, the shape of the hook-shaped engaging element of the hook-and-loop fastener was hardly affected by the cross-sectional shape of the rod-shaped body, the shape of the tip portion, and the presence or absence of heating in the heat treatment part I. As a result, it was found that the hook-and-loop fasteners of Reference Examples 1 to 4 had almost no difference in engaging force.

REFERENCE SIGNS LIST

1: Woven base fabric
2: Loop for hook-shaped engaging element
3: Rod-shaped body
31: Base portion of rod-shaped body
32: Heating portion of rod-shaped body
33: Tip portion of rod-shaped body
4: Heat treatment furnace
5: Fixed face or Roll face
6: Warp yarn
7: Weft yarn
8: Hook-shaped engaging element

The invention claimed is:

1. A woven-fabric hook-and-loop fastener comprising: a woven base fabric made of a woven-fabric made of a warp yarn and a weft yarn; a yarn for hook-shaped engaging elements made of a polyethylene terephthalate-based monofilament yarn woven into the woven base fabric in parallel with the warp yarn; and a large number of the hook-shaped engaging elements formed of the yarn for the hook-shaped engaging elements and rising from a front face of the woven base fabric, on a front face side of the woven base fabric, wherein a height of the hook-shaped engaging elements satisfies condition (1) described below and a hook shape of the hook-shaped engaging elements satisfies condition (2) described below:

(1) 90% or more of the hook-shaped engaging elements present on the front face of the base fabric have a height in a range of 0.975 to 1.025 times an average height (Ha) of the hook-shaped engaging elements;

(2) 90% or more of the hook-shaped engaging elements present on the front face of the base fabric have a lateral-direction spread (W) of the hook-shaped engaging elements within a range of 0.7 to 0.8 times with respect to the height (H) of the hook-shaped engaging elements.

2. The woven-fabric hook-and-loop fastener according to claim 1, wherein the weft yarn contains a heat-fusible fiber, a base of the hook-shaped engaging elements is fixed to the woven base fabric by a fused product of the heat-fusible fiber, and the woven base fabric satisfies that a thickness in a thickness direction of the woven base fabric at a position at which the warp yarn, which alternately runs over and under the weft yarn with the weft yarn interposed therebetween, subducts most toward a rear face side is 0.94 times or less of a thickness at a position at which the warp yarn floats most toward the front face side.

3. The woven-fabric hook-and-loop fastener according to claim 2, wherein the woven base fabric satisfies that the thickness of the warp yarn in the thickness direction of the woven base fabric at the position at which the woven base fabric subducts most toward the rear face side is in a range of 0.70 to 0.90 times the thickness at the position at which the warp yarn floats most toward the front face side.

4. The woven-fabric hook-and-loop fastener according to claim 1, wherein an average height (Ha) of the hook-shaped engaging elements is in a range of 1.45 to 1.65 mm.

5. The woven-fabric hook-and-loop fastener according to claim 1, wherein an adhesive layer for fixing the hook-shaped engaging elements to the woven base fabric is not present on a rear face of the woven base fabric.

6. A method for producing the woven-fabric hook-and-loop fastener according to claim 1 comprising: weaving a loop woven-fabric by weaving a yarn for hook-shaped engaging elements made of a polyethylene terephthalate-based monofilament yarn in parallel with a warp yarn at a time of weaving a woven base fabric from the warp yarn and a weft yarn, and at the same time, regularly allowing the yarn for the hook-shaped engaging elements to run over the warp yarn, and raising the yarn for the hook-shaped engaging elements in a loop shape from the front face of the woven base fabric at a running-over position; subsequently fixing a rising part of a loop to the woven base fabric; and then cutting one leg of the loop fixed to form hook-shaped engaging elements from the loop, wherein at a time of weaving the loop woven-fabric, Operations A to C described below are performed in the order of A to B to C, and then Step F described below is performed:

[Operation A] an operation of, at the time of weaving the loop woven-fabric, arranging a plurality of rod-shaped bodies having a longitudinally elongated cross-sectional shape in parallel with the warp yarn such that a longitudinal direction is substantially perpendicular to a face of the woven base fabric at a position at which the yarn for the hook-shaped engaging elements runs over the warp yarn, and forming a large number of loops made of the yarn for the hook-shaped engaging elements on the front face of the woven base fabric by allowing the yarn for the hook-shaped engaging elements to run over the rod-shaped bodies;

[Operation B] an operation of heating the loop in a state in which the loop runs over the rod-shaped bodies at a position at which a cross-sectional shape of the rod-shaped bodies is a shape protruding in a lateral direction in a middle of a height while sliding the loop on the rod-shaped bodies;

[Operation C] an operation of further sliding the loop on the rod-shaped bodies and pulling out the loop from an end of a tip of the rod-shaped bodies having a tapered shape;

[Step F] a step of cutting one leg of the loop to form the loop into a hook shape.

7. The method for producing the woven-fabric hook-and-loop fastener according to claim 6, wherein the rod-shaped bodies have a cross-sectional shape of an arc type protruding in the lateral direction in the middle of the height.

8. The method for producing the woven-fabric hook-and-loop fastener according to claim 6, wherein a tapered shape of a tip portion of the rod-shaped bodies is gradually tapered toward the end of the tip such that an upper face and a lower face of the rod-shaped bodies approach a center portion in a longitudinal direction of the rod-shaped bodies over a length in a range of 1 to 10 times a length in the longitudinal direction of the rod-shaped bodies, and the end of the tip is pointed.

9. The method for producing the woven-fabric hook-and-loop fastener according to claim 6, wherein a cross-sectional shape of the rod-shaped bodies does not protrude in the lateral direction in a region of the [Operation A], protrudes only on one side in the lateral direction in a region of the [Operation B], and has a tapered shape while maintaining a protruding shape in which only one side protrudes in the lateral direction at the tip portion.

10. The method for producing the woven-fabric hook-and-loop fastener according to claim 6, wherein a height in the longitudinal direction of a cross-sectional shape of the rod-shaped bodies has a constant height up to right before the tip portion in the region in which the Operation B is performed.

11. The method for producing the woven-fabric hook-and-loop fastener according to claim 6, wherein a tensile force applied to the yarn for the hook-shaped engaging elements at a time of feeding the yarn for the hook-shaped engaging elements to weave the yarn for the hook-shaped engaging elements into the woven is in a range of 70 to 90 g/yarn, a tensile force applied to the warp yarn when the warp yarn is fed is in a range of 40 to 60 g/yarn, and the tensile force applied to the yarn for the hook-shaped engaging elements is 15 to 40 g/yarn higher than the tensile force applied to the warp yarn.

12. The method for producing the woven-fabric hook-and-loop fastener according to claim 6, wherein the weft yarn contains a heat-fusible fiber, and Steps D and E as described below are performed in this order on the loop woven-fabric after performing the Operation C and before performing the Step F:

[Step D] a step of guiding the loop woven-fabric to a heating region, heating to a temperature equal to or higher than a temperature at which the heat-fusible fiber is melted, and fixing the rising portion of the loop to the woven base fabric by a melt from the heat-fusible fiber;

[Step E] a step of taking out the woven-fabric obtained in the Step D from the heating region, and pressing a rear face of the woven base fabric against a fixed face or a roll face in a state in which the heat-fusible fiber is melting.

13. The method for producing the woven-fabric hook-and-loop fastener according to claim 12, wherein the [Operation A] to the [Step E] are continuously performed without winding the woven-fabric in a middle.

14. The method for producing the woven-fabric hook-and-loop fastener according to claim 12, wherein the [Step E] is performed by pressing only the rear face side of the woven base fabric without pressing a front face side of the woven base fabric against the fixed face or the roll face.

15. The method for producing the woven-fabric hook-and-loop fastener according to claim 12, wherein the [Operation A] to the [Step F] are continuously performed without winding the woven-fabric in the middle.

* * * * *